US006513266B1

(12) United States Patent
Ijiri

(10) Patent No.: US 6,513,266 B1
(45) Date of Patent: Feb. 4, 2003

(54) SLIPPING PREVENTION DEVICE FOR FOOTWEAR

(76) Inventor: Yasuhiro Ijiri, 4-28-203, Terauchi 1-chome, Toyonaka-shi, Osaka (JP), 560-0872

( * ) Notice: Subject to any disclaimer, the term of this patent is extended or adjusted under 35 U.S.C. 154(b) by 0 days.

(21) Appl. No.: 09/623,849

(22) PCT Filed: Mar. 12, 1999

(86) PCT No.: PCT/JP99/01197

§ 371 (c)(1),
(2), (4) Date: Sep. 8, 2000

(87) PCT Pub. No.: WO99/45811

PCT Pub. Date: Sep. 16, 1999

(30) Foreign Application Priority Data

Mar. 13, 1998 (JP) ..... 10-082576
Oct. 20, 1998 (JP) ..... 10-318368

(51) Int. Cl.[7] ..... A43B 5/00; A43L 15/00

(52) U.S. Cl. ..... 36/134; 36/62; 36/64; 36/67 D

(58) Field of Search ..... 36/134, 59 R, 36/61, 62, 67 A, 67 D, 67 B, 127, 59 B, 64, 67 C

(56) References Cited

U.S. PATENT DOCUMENTS 2,607,134 A * 8/1952 Langer ..... 36/59 R
3,331,148 A * 7/1967 Hollister et al. ..... 36/67 A
3,715,817 A * 2/1973 White et al. ..... 36/67 D
4,035,934 A * 7/1977 Hrivnak ..... 36/67 D
4,651,448 A * 3/1987 Chen ..... 36/134
5,027,532 A * 7/1991 MacNeill et al. ..... 36/134
5,475,937 A * 12/1995 Korsen ..... 36/134
5,638,615 A * 6/1997 Korsen ..... 36/134
5,848,482 A * 12/1998 Bathum ..... 36/127
5,956,871 A * 9/1999 Korsen ..... 36/134
5,960,568 A * 10/1999 Bell et al. ..... 36/134

FOREIGN PATENT DOCUMENTS

GB 20288102 * 3/1980 ..... 36/67 D
JP 63-48188 12/1988
JP 3-86 1/1991
JP 11-89609 4/1999

* cited by examiner

*Primary Examiner*—Anthony D. Stashick
(74) *Attorney, Agent, or Firm*—McGlew and Tuttle, P.C.

(57) ABSTRACT

The thick-walled cylindrical portion 12 of a holder 10 is provided with axial grooves 18 that open to the inner peripheral surface. In the axial grooves 18, slip-off preventive projections 20 are radially inwardly elastically urged by their own elasticity. The substantially disk-like antislip portion 54 of an antislip body 50 is centrally formed with a cylindrical antislip body-associated fitting portion 56 projecting downward therefrom. The antislip body-associated fitting portion 56 is formed with a circumferential annular slip-off preventive groove 58 disposed somewhat above the lower end thereof. The antislip portion 54 is formed with antislip body-associated insert receiving portions 60 extending therethrough and disposed at positions corresponding to the slip-off preventive projections 20. Once the antislip body-associated fitting portion is fully to the holder-associated fitting portion, the antislip body can be easily and reliably held in the holder without using any tools. Furthermore, the antislip body can be easily and reliably removed from the holder by fully inserting fit-canceling inserts in the insert receiving portions.

21 Claims, 15 Drawing Sheets

(a)

(b)

SLIPPING PREVENTION DEVICE FOR FOOTWEAR

TECHNICAL FIELD

The present invention relates to an antislip device for footwear such as golf shoes, particularly an antislip device for footwear that is easy to mount and dismount and that can be reliably attached and detached.

BACKGROUND ART

Concerning antislip devices for golf shoes, spikes made of metal or ceramic have heretofore been used, but antislip devices made of synthetic resin have come into wide use for prevention of damage to greens and the like and for improved wearing feel. Such antislip devices made of synthetic resin are likely to wear easily as compared with those made of metal, so that an externally threaded raised portion made of metal or synthetic resin is formed on the back of the antislip device, while an internally threaded portion made of metal adapted to be threadedly fitted thereto is formed on the sole of a golf shoe, thereby making the antislip device removably mountable and exchangeable.

In the mounting and dismounting of the conventional antislip devices, however, in either of the attachment and detachment cases, a mounting/dismounting tool for turning the antislip device has to be used to turn it by as much amount as required; thus the operation of reliably threadedly mounting and dismounting all of the many antislip devices for a pair of golf shoes is troublesome. Furthermore, in the case where the externally and internally threaded portions, respectively, are made of metal, long-term use results in rusting to make the screws unturnable to the extent that removal of the screws is impossible or difficult, forcible removal tending to cause personal injury or damage or the like to the antislip mechanism. Further, in the case where the externally threaded portion is made of synthetic resin, improper tightening of the threaded portions could cause damage to the threads of the male screw or the stem of the male screw, resulting in the antislip device not being fully threadedly fixed and allowing it to come off during use. Further, if both of the internally and externally threaded portions, respectively, are made of synthetic resin, the threaded portions are likely to loosen and improper tightening damages one or both of their threads to the extent that the antislip device is likely not to be fully fixed; thus, such arrangement is impossible.

The present invention, which has been accomplished in view of the above problems inherent in the prior art, is to provide an antislip device for footwear that can be easily mounted and dismounted and reliably attached and detached.

DISCLOSURE OF THE INVENTION (1) An antislip device for footwear according to the present invention is;

an antislip device for footwear, comprising a holder used by being fixed to the bottom of footwear, and an antislip body to be held in said holder, said antislip body having an antislip portion that, when the antislip body is held in the holder fixed to the bottom of the footwear, contacts a surface to be trod by the bottom of the footwear so as to prevent the footwear from slipping relative to said surface, said holder and said antislip body have a holder-associated fitting portion and an antislip body-associated fitting portion, respectively, that fit together, said holder-associated fitting portion and said antislip body-associated fitting portion have a transverse support mechanism capable of preventing a relative movement between them in a direction orthogonal to the direction of fit when said antislip body-associated fitting portion fits in said holder-associated fitting portion, of such things as a slip-off preventive recess and a slip-off preventive projection capable of fitting in said slip-off preventive recess when the holder-associated fitting portion and the antislip body-associated fitting portion are fitted together, one is possessed by the holder and the other by the antislip body, either said slip-off preventive recess constituting portion or said slip-off preventive projection is urged in a direction in which it can be fitted to the other, said slip-off preventive recess and said slip-off preventive projection being shaped such that when they are relatively moved in a direction in which they are fitted together, they can be fitted together and when they are relatively moved in the opposite direction, their fitting is not canceled, one or more insert receiving portions being provided in which fit-canceling inserts can be inserted when the antislip body is in the state of being held in the holder fixed to the bottom of the footwear, said urged slip-off preventive recess constituting portion or slip-off preventive projection canceling the fit between the two by a force opposite in direction to said urging force that it receives from the inserts directly or through some other portion when the fit-canceling inserts are sufficiently inserted in the insert receiving portions.

The holder may be suitably formed of synthetic resin, metal, ceramic material, or a combination thereof. The holder is used by being fixed to the bottom of footwear. For example, it may be used by being embedded in and fixed to a synthetic resin footwear bottom (for example, a shoe sole, particularly a sport shoe sole, such as a golf shoe sole). Besides this, it may be formed by integral molding in such a footwear bottom, or may be formed by integral molding in the base portion of a footwear bottom, so that it is used in the state of being exposed to the bottom surface of the footwear bottom.

The antislip portion may be suitably made of synthetic resin, metal, ceramic material, or a combination thereof. Concerning the configuration of to the antislip portion, examples thereof are a group of small projections, a group of ridges, a linearly radially disposed ridge, a spirally radially disposed ridge, for example, a substantially circular plate-like body, which projects to the bottom surface side of the footwear bottom when the antislip body is held in the holder fixed to the footwear bottom.

Concerning the synthetic resin used for the holder and the antislip body, for example, nylon resin (for example, 66 nylon resin), urethane resin may be employed.

Either the holder-associated fitting portion or the antislip body-associated fitting portion may be a fitting projection and the other a fitting recess. For example, the antislip body may comprise a plate-like antislip portion having an antislip projection on the front and a pillar-like antislip body-associated fitting portion (fitting projection) erected on the back of the antislip portion, while the holder may comprise a hole-like holder-associated fitting portion (fitting recess) in which said antislip body-associated fitting portion fits. Further, for example, the holder may have a pillar-like holder-associated fitting portion (fitting projection) erected thereon, while the antislip body may have an antislip body-associated fitting portion (fitting recess) in which said holder-associated fitting portion fits in.

The transverse support mechanism may be constituted, for example, such that one of the outer and inner peripheral portions that support each other in a direction orthogonal to the direction of fit upon fitting between the holder-associated fitting portion and the antislip body-associated fitting portion is provided in the holder-associated fitting portion at two or more places or continuously in the direction of fit, and the other in the antislip body-associated fitting portion. Examples of such combinations of the outer and inner peripheral portions are a cylindrical inner peripheral surface and a cylindrical outer peripheral surface; an inner peripheral surface and an outer peripheral surface that are polygonal in cross section (for example, regular polygonal in cross section); an inner peripheral surface and an outer peripheral surface that are elliptic in cross section. (In each case, there may be one or more discontinuous portions disposed peripherally or in the direction of fit. For example, if the cylindrical inner peripheral surface or cylindrical outer peripheral surface is peripherally discontinuous, this results in one or more arcuate inner peripheral surface or arcuate outer peripheral surfaces that are continuous in the direction of fit.) Besides these, another example is a combination of one of said inner and outer peripheral surfaces and the other that is replaced by a required number of ridges that extend substantially in the direction of fit and whose edges extend along the surface.

The transverse support mechanism may be composed of a cylindrical inner peripheral surface and a cylindrical outer surface (each may have one or more discontinuous portions disposed peripherally or in the direction of fit) such that rotation of the antislip body relative to the holder around the axis extending in the direction of fit is allowed in consideration of protection of the portion of turf or the like that is to be trod, control of wear of the antislip portion of the antislip body, etc. In addition, for example, in order to exert an advantageous antislip function as much as possible in games such as golf, antislip devices that are rotatable and antislip devices that are nonrotatable may be used, mixedly disposed according to the positions of the antislip devices on the footwear bottom.

It is desirable that this antislip device for footwear have a direction-of-fit support mechanism that supports such that when the antislip body-associated fitting portion is fitted to the holder-associated fitting portion, the depth of fitting is prevented from exceeding a certain limit.

The direction-of-fit support mechanism may be constituted, for example, by providing a holder-associated support portion and an antislip body-associated support portion that contact each other when the depth of fitting reaches a certain limit when the antislip body-associated fitting portion is fitted to the holder-associated fitting portion and that support each other in the direction of fit or in a direction having a component of the direction of fit.

Examples of the holder-associated support portion and antislip body-associated support portion will be given as to a case in which the antislip body comprises a plate-like antislip portion having an antislip projection on the front, and a pillar-like antislip body-associated fitting portion (fitting projection) erected on the back of the antislip portion while the holder comprises a bottomed hole-like holder-associated fitting portion (fitting recess) in which said antislip body-associated fitting portion fits in. In one example, the holder-associated support portion is the peripheral edge of the opening in the holder-associated fitting portion (fitting recess) while the antislip body-associated support portion is the peripheral edge of the antislip body-associated fitting portion (fitting projection) on the back of the antislip portion, and in another example, the antislip body-associated support portion is the front end of the antislip body-associated fitting portion (fitting projection) while the holder-associated support portion is the bottom of the holder-associated fitting portion (fitting recess).

In addition, in place of such holder-associated support portion, a support portion that supports, and is supported by, the antislip body-associated support portion may be provided in the footwear bottom.

Concerning the slip-off preventive recess, for example, one or more recesses substantially corresponding in size to the slip-off preventive projection may be provided. Besides this, it may, for example, be a groove endlessly extending around the axis extending in the direction in which the antislip body-associated fitting portion is fitted to the holder-associated fitting portion. Further, the slip-off preventive projection may be replaced by one or more projections substantially corresponding in size to the slip-off preventive recess. Besides this, it may, for example, be a projection endlessly extending around the axis extending in the direction in which the antislip body-associated fitting portion is fitted to the holder-associated fitting portion. If said transverse support mechanism, as in the case of being composed of the cylindrical inner and outer peripheral surfaces, allows relative rotation around the axis of the direction of fit with the holder-associated fitting portion and antislip body-associated fitting portion fitted together, it is desirable that the slip-off preventive recess be an endlessly continuous groove as described above or that the slip-off preventive projection be an endlessly continuous edge as described above, in order to enable the slip-off preventive projection to fit in the slip-off preventive recess irrespective of the angle of rotation between them. In this case, however, the term "endlessly" does not necessarily mean "perfectly endlessly;" thus, the presence of a discontinuous portion somewhere is allowed provided that the slip-off preventive projection is allowed to fit in the slip-off preventive recess irrespective of the angle of rotation between them.

The urging force exerted in a direction in which either the slip-off preventive recess constituting portion or the slip-off preventive projection receives said force and is fitted to the other, is elastic. That is, it can be arranged that either the slip-off preventive recess constituting portion or the slip-off preventive projection receives an elastic force in a direction in which it can be fitted to the other. For example, such urging may be effected by the elasticity possessed either by the slip-off preventive projection or by the slip-off preventive recess constituting portion, or it may be effected by the elasticity of an elastic member, such as a compression spring or tension spring, subjected either to the slip-off preventive projection or to the slip-off preventive recess constituting portion. Alternatively, it may be effected by the elasticity possessed either by a portion having the slip-off preventive projection or by a portion having the slip-off preventive recess constituting portion (for example, it may be effected by the elasticity possessed by the cantilever-like portion).

Concerning the slip-off preventive recess and slip-off preventive projection, in order to attain a shape that ensures that the fit is not canceled in the case of a relative movement taking place in a direction opposite to the direction in which the antislip body-associated fitting portion is fitted to the holder-associated fitting portion, that is, in a direction to cancel the fit, it is possible to employ a shape, for example, such that the angle between the surfaces in the fitting innermost regions in both of the slip-off preventive recess and the slip-off preventive projection and the fit-canceling direction is an acute angle or substantially right angle. Concerning a shape that allows the antislip body-associated fitting portion to be fitted to the holder-associated fitting portion in the case of a relative movement taking place in the direction that allows fitting, it is possible to employ a shape, for example, such that the angle between the surface in a region opposite to the fitting innermost region in the slip-off preventive projection and the direction of fit is an obtuse angle. In other arrangements also, for example, in the case of relative movement taking place in the fit-canceling direction, the fit will not be canceled if the side urged in a direction in which either the slip-off preventive projection or the slip-off preventive recess constituting portion is fitted to the other, tends to move in the direction of the urging force.

It is desirable that the fit between the slip-off preventive recess and slip-off preventive projection be effected at two or more places. The reason is that even if the fit at one place should be canceled by some cause or other against the user's will, falling-off of the antislip body from the holder can be prevented.

Concerning the provision of the insert receiving portion, there are various cases including one in which it is provided in the antislip body alone, another in which it is provided in the holder alone, and another in which it extends through the antislip body to reach the holder. In the case where the insert receiving portion extends through the antislip body to reach the holder and the antislip body is allowed to rotate relative to the holder around the axis of the direction of fit with the holder-associated fitting portion and the antislip body-associated fitting portion fitted together, the insert receiving portion sometimes coincides between the antislip body and the holder and sometimes does not, depending on the angle of rotation of the antislip body. Thus, in this case, in order to sufficiently insert the insert in the fit-canceling insert in the insert receiving portion, the angle of rotation of the antislip body will be adjusted as needed. In that case, if the position of the insert receiving portion in the holder is indicated at a visible position in the holder or the footwear bottom, this is convenient for adjusting the rotation angle position of the antislip body. The position of the insert receiving portion may be shown by symbols, such as arrows, figures, letters or a combination thereof, by a planar indication using a paint or the like, or by unevenness or the like.

Concerning the shape of the insert receiving portion, holes or the like of circular or quadrangular cross section may be suitably employed and, though not particularly restricted, the cross sectional area of the insert receiving portion (particularly, the cross sectional area of the insert receiving port) is preferably as small as possible. This is for the purpose of preventing undesirable occurrences in which in the period of use until replacement of the antislip body becomes necessary, various pointed and other substances lying on the ground, floor surfaces or the like accidentally enter the insert receiving portion to cancel the fit between the slip-off preventive recess and the slip-off preventive projection or to clog the insert receiving portion. In order to prevent such undesirable occurrences more reliably, it is desirable that the insert receiving portion (desirably, the insert receiving port of the insert receiving portion) be closed by a removable or destroyable cover. Such cover is not necessarily required to effect perfect closure.

The insert receiving portion is required to have a position and a shape such that the insertion of the fit-canceling insert exerts a force that is opposite in direction to said urging force on the urged slip-off preventive recess constituting portion or urged slip-off preventive projection directly or through another portion and that is capable of moving the urged slip-off preventive recess constituting portion or slip-off preventive projection in the direction in which the fit between the two is canceled.

Concerning the arrangement in which the urged slip-off preventive recess constituting portion or urged slip-off preventive projection receives a force opposite in direction to said urging force directly or through another portion as a results of the fit-canceling insert being inserted in the insert receiving portion, the following arrangement may be cited: an arrangement in which, for example, the slip-off preventive projection or slip-off preventive recess constituting portion itself, the elastic member that urges the slip-off preventive projection or slip-off preventive recess constituting portion, or the portion having the slip-off preventive projection or slip-off preventive recess constituting portion (for example, the cantilever-like portion) has a portion inclined in the direction of said urging force with respect to the direction of fit between the holder and antislip body when the slip-off preventive projection and slip-off preventive recess are fitted together, so that said inclined portion receives a force opposite in direction to said urging force when pressed by the insert.

The shape of the fit-canceling insert is required to be such that the insert can be inserted in the insert receiving portion to a sufficient depth. In the case of an arrangement in which two or more urged slip-off preventive projections or two or more urged slip-off preventive recess constituting portions are simultaneously fitted to the slip-off preventive recesses or slip-off preventive projections, it is desirable that the fit-canceling insert be formed in, for example, a bifurcated shape (or a three-branched or more-branched shape) and the two or more urged slip-off preventive projections or two or more urged slip-off preventive recess constituting portions can be simultaneously moved in the fit-canceling direction.

If the antislip body-associated fitting portion of the antislip body is sufficiently fitted to the holder-associated fitting portion of the holder fixed to the footwear bottom, the slip-off preventive recess constituting portion or slip-off preventive projection is urged until the slip-off preventive projection fits in the slip-off preventive recess and cancellation of the fit between the holder-associated fitting portion and the antislip body-associated fitting portion is prevented so that the antislip body is fixedly held by the holder.

The transverse support mechanism prevents displacement and inclination of the antislip body-associated fitting portion relative to the holder-associated fitting portion in a direction orthogonal to the direction of fit. This prevents undesirable occurrences including the antislip body being unstably held in the footwear bottom to fail to exert the sufficient antislip effect, breakage or wear occurring in the holder-associated fitting portion or antislip body-associated fitting portion, and the hold of the antislip body provided by the holder being canceled during use to result in the antislip body falling off.

In order to release the antislip body from the holder, a fit-canceling insert is sufficiently inserted in the insert receiving portion. Thereby, the insert exerts a force in the urged slip-off preventive recess constituting portion or slip-off preventive projection directly or through another portion, said force being opposite in direction to said urging force, thereby moving the urged slip-off preventive recess constituting portion or slip-off preventive projection in a direction in which the fit between the two is canceled, thus canceling the fit between the slip-off preventive recess and the slip-off preventive projection, so that the antislip body can be removed from the holder.

The mounting and dismounting of the antislip body on and from the holder can be effected in a simple operation, without requiring force and trouble to tighten screws with great force for fixing against loosening or turning them backward with great force for removal as in the case of using a screw mechanism. Therefore, mounting and dismounting are easy for women, old people, children, etc. Further, unlike screws made of metal, there is no danger of prolonged use resulting in rusting to make removal impossible or difficult, a fact which is likely to cause injuries to the user or breakage or the like to the antislip mechanism, or unlike screw threads made of synthetic resin, there is no danger that tightening leads to breakage of the screw or the screw stem, which, in turn, causes the antislip body to fail in being threadedly sufficiently fixedly held and to come off during use. Furthermore, since the holder and the antislip body can both be made of synthetic resin, the effectiveness is high in reducing the weight of the entire footwear including the fittings, as compared with the prior art in which at least the holder is made of metal.

(2) The footwear antislip device of (1) may be such that;

the antislip body-associated fitting portion is a fitting projection having a cylindrical outer peripheral surface that may have one or more circumferentially disposed discontinuous portions, while the holder-associated fitting portion is a fitting recess having a cylindrical inner peripheral surface that may have one or more circumferentially disposed discontinuous portions, said cylindrical outer and inner peripheral surfaces constituting the transverse support mechanism.

In this case, irrespective of the angle around the axis extending in the direction of fit in which the antislip body is fitted to the holder, the antislip body-associated fitting portion can be fitted to the holder-associated fitting portion to fixedly hold the antislip body in the holder and the antislip body is allowed to rotate relative to the holder.

In addition, a recessed portion and a raised portion that fit together when the antislip body is held in the holder may be provided in the holder and the antislip body, whereby the rotation of the antislip body relative to the holder when the antislip body is held in the holder can be made impossible.

(2-1) The footwear antislip device of (2) may be such that;

when the holder-associated fitting portion and antislip body-associated fitting portion are fitted together, they are relatively turnable around the axis extending in the direction of fit, and the antislip body-associated fitting portion has a circumferentially endlessly continuous groove-like slip-off preventive recess while the holder has one or more slip-off preventive projections capable of fitting in said slip-off preventive recess.

Since the slip-off preventive projection is allowed to fit in the slip-off preventive recess irrespective of the angle of rotation between the holder-associated fitting portion and the antislip body-associated fitting portion, the operation of fitting the antislip body-associated fitting portion to the holder-associated fitting portion so as to attach the antislip body to the holder is easy.

(2-2) The footwear antislip device of (2-1) may be such that;

the holder has one or more cantilever-like portions each having a base portion on the fitting port side of the holder-associated fitting portion and a radially inwardly projecting slip-off preventive projection at the front end extending toward the innermost fitting region, said cantilever-like portion having an inner surface that is radially inwardly inclined toward the innermost fitting region when the slip-off preventive projection is fitted in the slip-off preventive recess, the arrangement being such that when the fit-canceling inserts are sufficiently inserted in the insert receiving portions, the inserts press and radially outwardly elastically deform the inner surfaces thereof, thereby canceling the fit between the slip-off preventive projection and the slip-off preventive recess.

The antislip body can be attached to the holder irrespective of the angle of rotation between the holder-associated fitting portion and the antislip body-associated fitting portion. Further, sufficiently inserting the fit-canceling insert in the insert receiving portion results in the insert pressing the inner surface thereof to radially outwardly elastically deform the cantilever-like portion, thereby canceling the fit between the slip-off preventive projection and the slip-off preventive recess, so that the antislip body can be detached from the holder. In that case, a force in a direction in which the insert is released from the insert receiving portion can be applied to the insert by the inner surface of the urged cantilever-like portion. Further, if this pressure force on the inner surface is canceled, the cantilever-like portion and the slip-off preventive projection are restored to their original positions.

(2-3) The footwear antislip device of (2) may be such that when the holder-associated fitting portion and the antislip body-associated fitting portion are fitted together, they are relatively rotatable around the axis extending in the direction of fit, the holder has a slip-off preventive projection while the antislip body-associated fitting portion has a slip-off preventive recess, said slip-off preventive projection being urged in a direction in which it can fit in said slip-off preventive recess, the insert receiving portion comprises an antislip body-associated insert receiving portion extending through the antislip body and a holder-associated insert receiving portion possessed by the holder, the arrangement being such that with the rotation angle position of the antislip body-associated insert receiving portion coinciding with the position of the holder-associated insert receiving portion, the fit-canceling insert inserted in said antislip body-associated insert receiving portion is sufficiently inserted in the holder-associated insert receiving portion, thereby making it possible to cancel the fit between the slip-off preventive projection and the slip-off preventive recess.

This footwear antislip device may be such that the number of antislip body-associated insert receiving portions is greater than the number of holder-associated insert receiving portions, and the antislip body has two or more angles of rotation relative to the holder such that the position of the antislip body-associated insert receiving portion coincides with the position of the holder-associated insert receiving portion, the cancellation of the fit between the slip-off preventive projection and the slip-off preventive recess is made possible, which, in turn, makes possible the cancellation of the fit between the antislip body-associated fitting portion and the holder-associated fitting portion.

In this case, a smaller angle of rotation is sufficient to align the angle of rotation of the antislip body-associated insert receiving portion with the position of the holder-associated insert receiving portion.

The footwear antislip device has two or more rotation angle positions of the antislip body relative to the holder that allow cancellation of the fit between the antislip body-associated fitting portion and the holder-associated fitting portion, and it is preferable that the central angles at the respective rotation angle positions be equal or substantially equal. That is, where the number of rotation angle positions is represented by n, the central angle is approximately (360/n) degrees. In this case, the angle of rotation required to make the rotation angle position of the antislip body-associated insert receiving portions coincide with the position of the holder-associated insert receiving portions is always at a minimum. As a preferred example, the footwear antislip device has two holder-associated insert receiving portions spaced a central angle of 180 degrees apart at a given radial position and four antislip body-associated insert receiving portions spaced a central angle of 90 degrees at the same given radial position as in the holder-associated insert receiving portion. In this case, in any of the four antislip body-associated insert receiving portions, inserts are simultaneously sufficiently inserted in the two holder-associated insert receiving portions and the antislip body-associated insert receiving portions that coincide with them, whereby the fit between the slip-off preventive projection and the slip-off preventive recess can be canceled.

(3) The footwear antislip device of said (1), (2), (2-1), (2-2) or (2-3) may be such that the antislip portion has a substantially plate-shape portion so that when the antislip body is held in the holder, the outer periphery of the antislip body and the outer periphery of the holder press against each other throughout the periphery.

In order to effect cancellation of the fit between the antislip body-associated fitting portion and the holder-associated fitting portion, it is necessary to sufficiently insert the fit-canceling insert in the insert receiving portion through said opening to cancel the fit between the slip-off preventive projection and the slip-off preventive recess. However, if particles of stone, sand or earth, grass, dust, dirt, etc. enter between the antislip body and the holder, there is the danger of the slip-off preventive recess constituting portion or the slip-off preventive projection failing to operate or of it becoming impossible to insert the fit-canceling insert in the insert receiving portion to effect cancellation of the fit between the slip-off preventive projection and the slip-off preventive recess, or the danger of the intrusive extraneous substances clogging the fitting region between the antislip body-associated fitting portion and the holder-associated fitting portion to make impossible cancellation of the fit itself between the antislip body-associated fitting portion and the holder-associated fitting portion.

In the case of this footwear antislip device, in the state in which the footwear is used, that is, in the state in which the antislip body is held in the holder fixed in the footwear bottom and is ready to tread on the ground, the outer peripheries of the antislip body and holder are pressed against each other throughout the periphery, so that particles of stone or the like are prevented from entering therebetween from the outer peripheries of the antislip body and holder; therefore, cancellation of the fit between the slip-off preventive projection and the slip-off preventive recess and cancellation of the fit between the antislip body-associated fitting portion and the holder-associated fitting portion can be effected more reliably.

Ensuring that the outer peripheries of the antislip body and holder are pressed against each other throughout the periphery with the antislip body held in the holder, is made possible by determining the dimensional relationship such that, for example, a compressive force acts between the outer peripheries of the antislip body and holder upon fitting between the slip-off preventive projection and the slip-off preventive recess owing to the fit between the antislip body-associated fitting portion and the holder-associated fitting portion.

It is preferable that the outer peripheries of the holder and antislip body be pressed against each other in an annular surface region or circumferential region that is rotation-symmetrical with respect to the axis of the direction of fit. In the case of the annular surface region, it may be an annular flat region normal to said axis, an annular inclined flat region inclined at a given angle with respect to said axis, an annular curved region, or the like.

Further, it may be arranged that the outer peripheries of the antislip body and holder are pressed against each other throughout the periphery with the outer periphery of the antislip body externally covering the outer periphery of the holder so that entry of particles of stone, sand or earth, grass, dust, dirt, etc. can be prevented more effectively.

In addition, in the case where the outer periphery of the antislip body is positioned outwardly of the outer periphery of the holder, it may be arranged that the outer periphery of the antislip body is pressed against the bottom surface of the footwear bottom throughout the periphery with the antislip body held in the holder fixed to the footwear bottom to prevent fine particles of stone or sand from entering between the antislip body and the holder. In this case, however, in order to produce a given degree of pressing force always between the outer periphery of the antislip body and the bottom surface of the footwear bottom, it is required that the accuracy of the positional relationship between the holder and the bottom surface of the footwear bottom be high to a given degree or above.

(4) The footwear antislip device of said (1), (2), (2-1), (2-2), (2-3) or (3) may be such that;

the insert receiving portion has an opening that opens to a surface to be trod by the bottom of the footwear when the antislip device is attached to the bottom of the footwear to be ready for use, through which opening the fit-canceling insert can be inserted in the insert receiving portion, said opening having a valve flap that is pushed open toward the insert receiving portion by inserting said insert in said insert receiving portion and that is restored to its original position by extracting said insert from said insert receiving portion, said opening being closed or substantially closed by said valve flap.

For cancellation of the fit between the antislip body-associated fitting portion and the holder-associated fitting portion, it is necessary to insert the fit-canceling insert in the insert receiving portion through said opening. If, therefore, fine particles of stone, sand or earth, grass, dirt or the like enter the insert receiving portion through said opening to clog it to make it impossible to insert the insert, the fit between the antislip body-associated fitting portion and holder-associated fitting portion cannot be canceled, so that the antislip body cannot be released from the holder. In the case of this footwear antislip device, however, said opening in the insert receiving portion is closed or substantially closed by a valve flap that can be pressed open toward the insert receiving portion by the insert being inserted in the insert receiving portion and that can be restored to its original portion by said insert being extracted from the insert receiving portion, thereby preventing a danger that it becomes impossible to insert the insert as the insert receiving portion is clogged; thus, fit-cancellation can be effected more reliably. Further, as compared with the case of the insert receiving portion being closed by a breakable cover, the insert is less liable to be damaged when inserted in the insert receiving portion. Further, when fine particles of stone, sand earth or the like are finding their way into the insert receiving portion by pressing the valve flap inward, these particles can be expelled outward by the restoring force of the valve flap.

The term "substantially closed" refers to a state in which, for example, there is a slight clearance between the inner periphery of the opening and the outer periphery of the valve flap.

The valve flap is preferably made of a material that can be restored by its own elasticity. Examples thereof are polyurethane resin, polypropylene resin, and acrylonitrile-butadiene-styrene copolymer resin. The antislip body is preferably made by integral molding of synthetic resin together with the valve body.

(4-1) The footwear antislip device of (4) may be such that the insert receiving portion comprises an antislip body-associated insert receiving portion extending through the antislip body and a holder-associated insert receiving portion possessed by the holder, the opening in the antislip body-associated insert receiving portion has a valve flap, the arrangement being such that when the insert is inserted in the insert receiving portion, said valve body elastically presses the insert in the vicinity of the opening.

Since the valve flap elastically presses the insert in the vicinity of the opening when the insert is inserted in the insert receiving portion to cancel the fit between the slip-off preventive projection and the slip-off preventive recess, the valve flap of the antislip body can be kept pressing and holding the insert and the antislip body can be released along with the insert by moving the insert in the direction of release when the antislip body is to be released from the holder. Particularly in the case of the footwear antislip device of (2-2), the inner surface of the urged cantilever-like portion can apply a force to the insert in a direction in which the insert is released from the insert receiving portion, so that release of the antislip body is easier.

(5) The footwear antislip device of said (1), (2), (2-1), (2-2), (2-3), (3), (4) or (4-1) is preferably such that the antislip portion of the antislip body is made of relatively soft material, while the slip-off preventive recess and the slip-off preventive projection are made of relatively rigid material.

Making the antislip portion of a relatively soft material (for example, polyurethane resin) contributes much to prevention of damage to greens and building floors and to improved wearing feel, while making the slip-off preventive recess and slip-off preventive projection of a relatively rigid material (for example, nylon resin or metal, or where elasticity is not required, ceramic material or the like) prevents undesirable occurrences in which an unexpected force acts during use to cancel the fit between the slip-off preventive recess and the slip-off preventive projection or in which the slip-off preventive recess or the slip-off preventive projection wears out so that the fit therebetween is accidentally canceled.

(5-1) The footwear antislip device of said (2-1), (2-2) or (2-3) is preferably such that the antislip portion of the antislip body is made of relatively soft material, while the antislip body-associated fitting portion and the holder are made of relatively rigid material.

In this case, as in the case of said (5), the antislip device contributes to prevention of damage to greens and building floors and to improved wearing feel, and prevents undesirable occurrences in which an unexpected force acts during use to cancel the fit between the slip-off preventive recess and the slip-off preventive projection or in which the slip-off preventive recess or the slip-off preventive projection wears out so that the fit therebetween is accidentally canceled.

(5-2) The footwear antislip device of said (5) or (5-1) may be such that the antislip body is an integral combination of a pillar-like body of relatively rigid material whose one end has lateral extensions and whose other end constitutes an antislip body-associated fitting portion, and an antislip portion of relatively soft material covering said lateral extensions of said pillar-like body.

Such antislip portion can be produced, for example, by molding and solidifying a relatively soft synthetic resin material (for example, polyurethane resin) in such a manner as to cover the lateral extensions of the pillar-like body produced in advance of a relatively rigid material (for example, nylon resin, metal, ceramic material). In this case, such extension may be laterally extended, for example, throughout the periphery (for example, in the form of a circular plate or a polygon); however, in order to ensure the integration of the pillar-like body and the antislip portion, it is preferable that the extensions be laterally extended in some directions (2 directions, 3 directions, 4 directions, etc.) and that the relatively soft synthetic resin material fill the space between the lateral extensions and solidify therein. In the case where they laterally extend in some directions, it is preferable that the lateral extensions be provided at intervals of an equal central angle. Further, the integration of the pillar-like body and the antislip portion may be ensured by providing axial through-holes in the lateral extensions so that the relatively soft synthetic resin material fills said through-holes and solidifies therein.

(6) The footwear of the present invention includes said footwear antislip device described in said (1), (2), (3) or(4) with a holder fixed in the footwear bottom.

(7) The fit-canceling device of the present invention comprises a grip, and two or more inserts extending in parallel with each other from said grip. If it is necessary to simultaneously insert inserts in a plurality of insert receiving portions parallel with the axis of the direction of fit in order to cancel the fit between the slip-off preventive projection and the slip-off preventive recess so as to separate the holder and the antislip body from each other, the user, griping the grip of the fit-canceling tool having a required number of inserts projecting in parallel with each other in an arrangement corresponding to the arrangement of the insert receiving portions, simultaneously inserts the inserts in the plurality of insert receiving portions. Thereby, the fit of all of the two or more slip-off preventive projections and slip-off preventive recesses can be simultaneously canceled to separate the holder and the antislip body from each other.

The inserts may be, for example, a linear bar in shape, but it goes without saying that they should correspond in shape to the insert receiving portions of the intended footwear antislip device.

The material and shape of at least the insert portions of this fit-canceling tool are preferably such that the insertion and extraction of the inserts in and from the insert receiving portions of an intended footwear antislip device can be effected within the limit of the elasticity of the material. The reason is that if the inserts are deformed when they are inserted or extracted, the inserts become unsuitable for reuse.

The antislip body of the footwear antislip device may have at least its central portion projected toward a surface to be trod by the footwear bottom when it is used by being attached to the holder fixed in the footwear bottom and may have projections that are discontinuous around the circumference with the direction-of-fit axis taken as the centerline (which projections likewise project toward the surface to be trod by the footwear bottom, such as circumferentially spaced small projections or substantially radial ridges). In that case, this fit-canceling tool has a plate-like portion in its grip, which plate-like portion has a turning recess in which said at least central portion of the antislip body fits, and upon fitting, the peripheral edge of said turning recess in the grip is allowed to be positioned between said circumferentially discontinuous projections, and by turning the grip around the direction-of-fit axis of the antislip body, the peripheral edge of said recess is caused to act on the projections of the antislip body to turn the antislip body, held in the holder, through an optional angle; thus, the problem of wear of the projections of the antislip body, etc. can be coped with.

BEST MODE FOR EMBODYING THE INVENTION

Embodiments of the invention will now be described with reference to the drawings.

Figure 1:
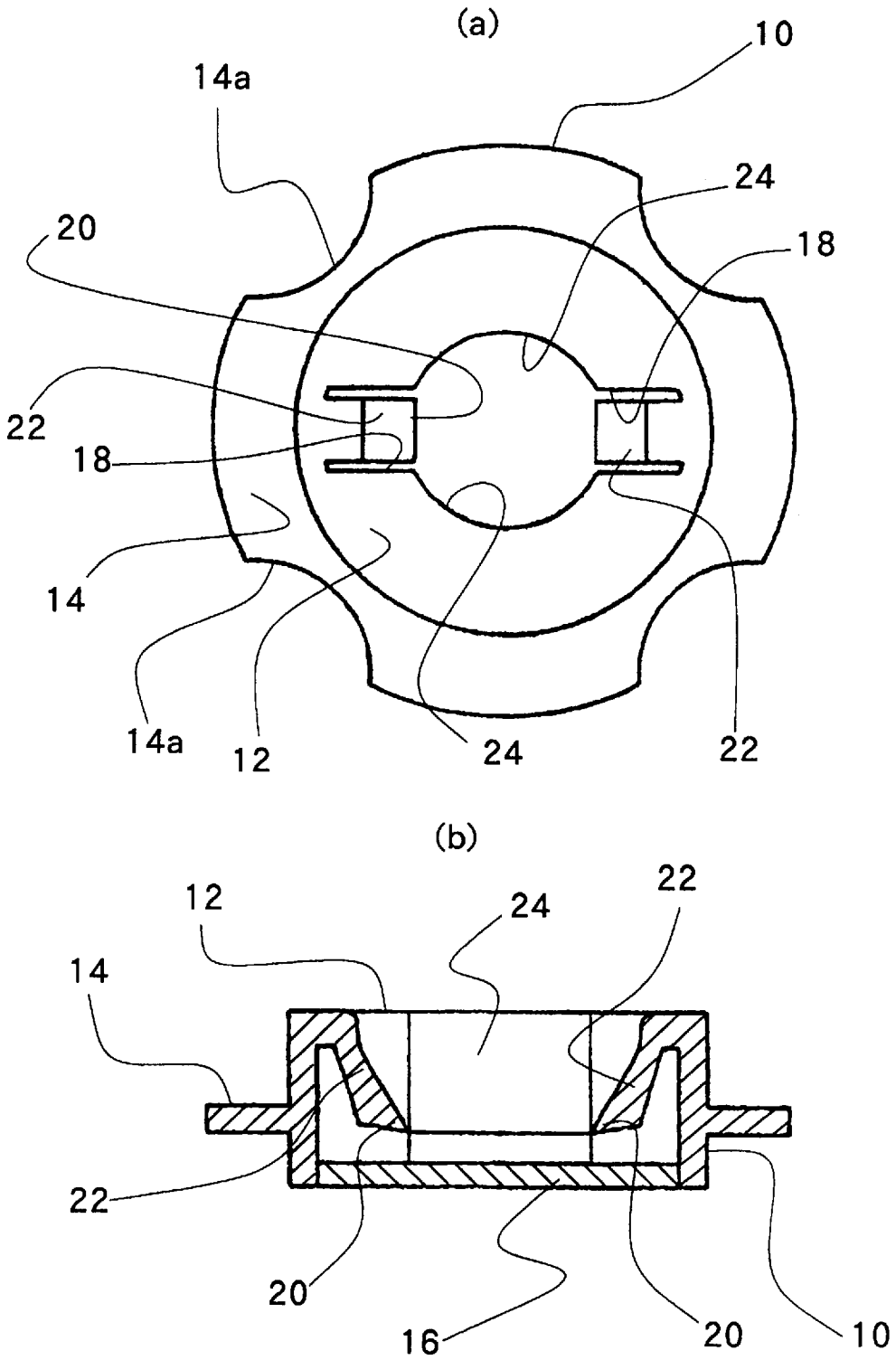
FIGS. 1*a–b* is a plan view and a central longitudinal sectional view of a holder.
Figure 2:
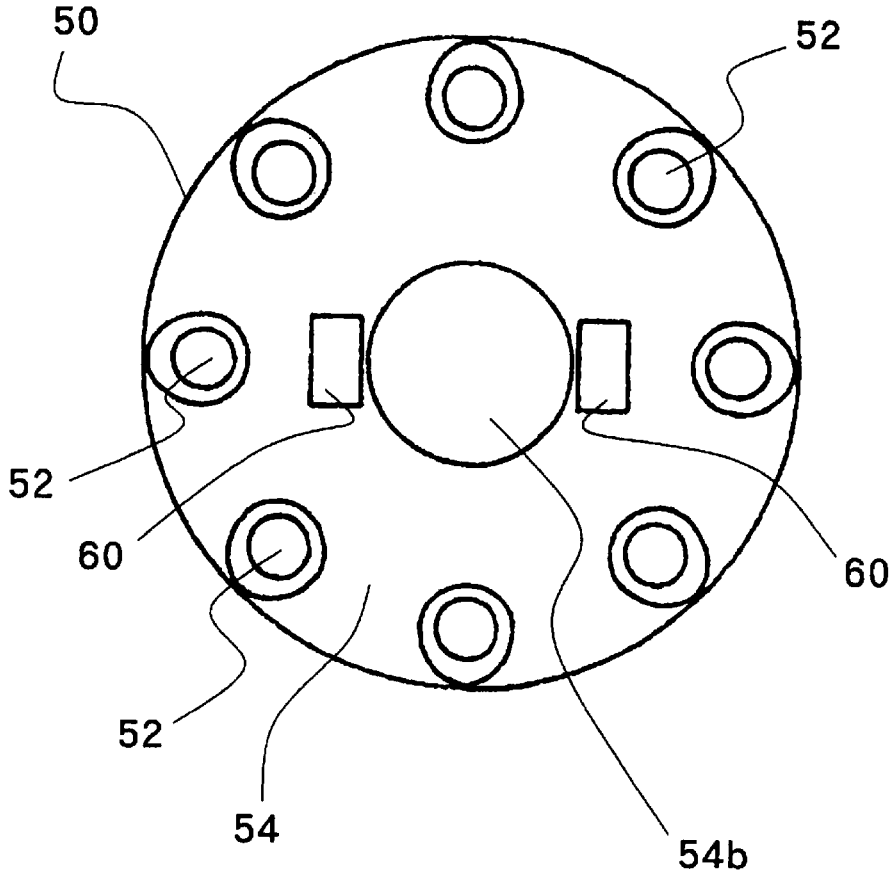
FIGS. 2*a–b* is a plan view and a central longitudinal sectional view of an antislip body.
Figure 2:
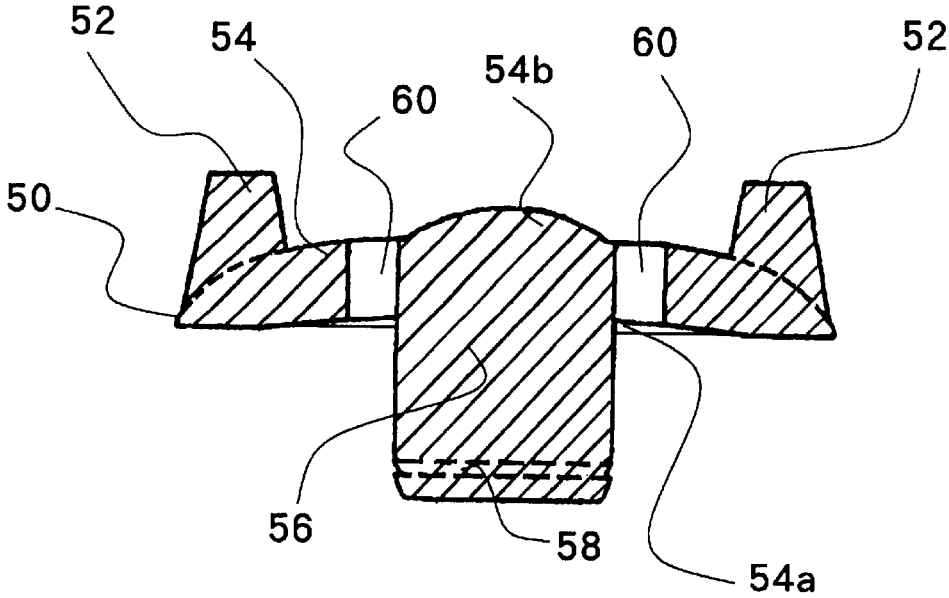
Figure 3:
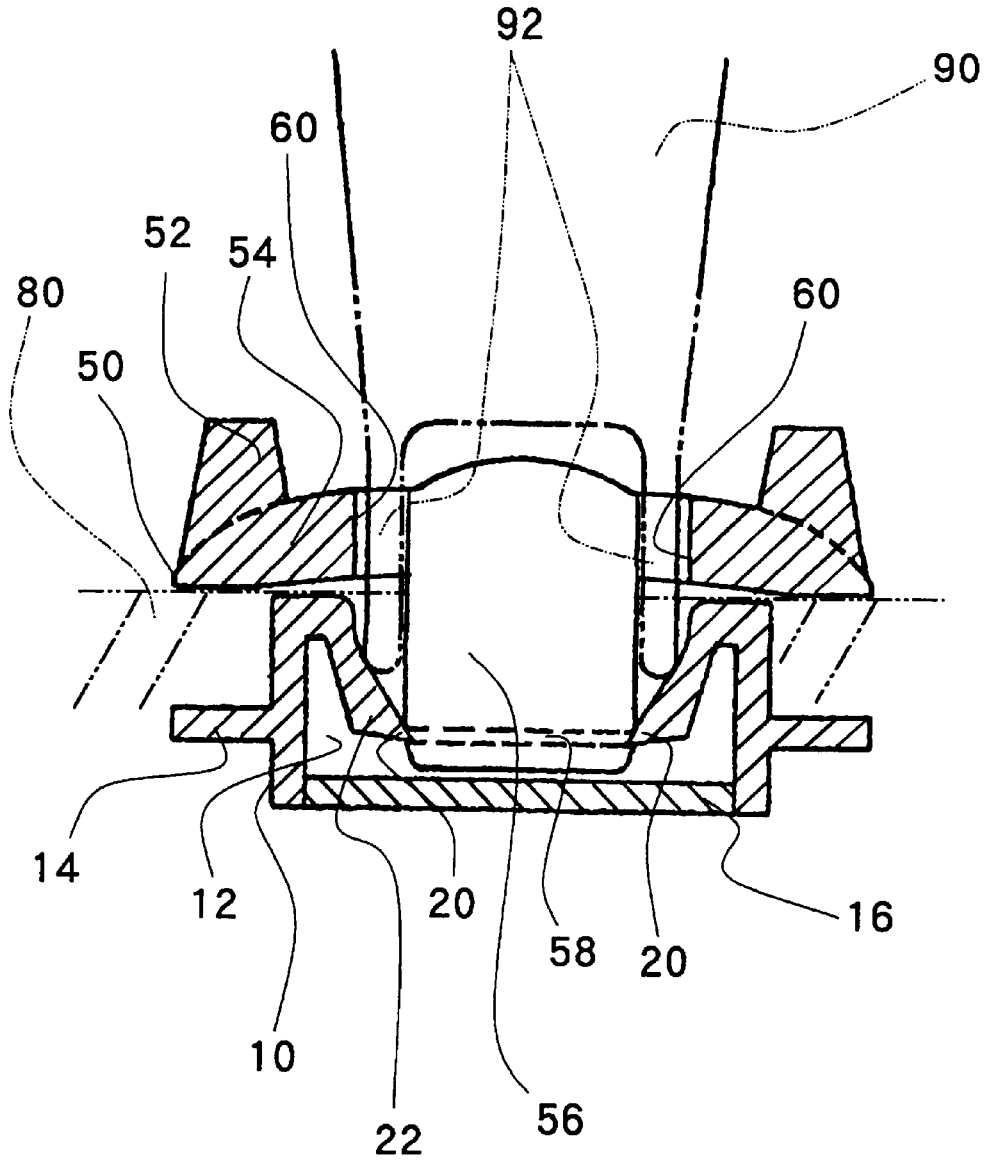
FIG. 3 is a central longitudinal sectional view of the antislip device shown in the state of use.

FIGS. 1 through 3 each relate to an antislip device for golf shoes as an example in which the antislip device for footwear of the invention is embodied. However, it is also applicable to various other types of sport shoes and other footwear.

FIG. 1(*a*) is a plan view of a holder. FIG. 1(*b*) is a central longitudinal sectional view of the holder. FIG. 2(*a*) is a plan view of an antislip body. FIG. 2(*b*) is a central longitudinal sectional view of the antislip body. FIG. 3 is a central longitudinal sectional view showing the antislip device in the state of use.

This antislip device consists of a holder 10 of 66 nylon resin and an antislip body 50. Therefore, a golf shoe having this antislip device is lightweight, as compared with a conventional one.

The holder 10 comprises a thick-walled cylindrical portion 12, a flange 14 radially outwardly extending throughout the periphery at the axially intermediate position, and a bottom plate 16 closing the lower portion shown in FIG. 1.

The flange 14 has bow-shaped notches 14a at four places spaced through a central angle of 90 degrees apart. The presence of such notches 14*a* in the flange 14 ensures that when the holder 10 is embedded and fixed, for example, in a shoe sole of synthetic rubber at position below the upper end of FIG. 1(*b*) as by insert molding, the holder 10 can be reliably prevented from turning around its axis. Further, the bottom plate 16 prevents the synthetic rubber or the like from entering the thick-walled cylindrical portion 12 of the holder 10 when the holder 10 is embedded and fixed as by insert molding.

At two places spaced a central angle of 180 degrees apart in the thick-walled cylindrical portion 12 of the holder 10, there are axial grooves 18 (holder-associated insert receiving portions) that open to the inner peripheral surface. Each axial groove 18 has a tongue piece 22 (cantilever-like portion) that has a base portion on the outer periphery of the upper portion (on the side associated with the fitting port) of the thick-walled cylindrical portion 12 and whose front end portion directed downward (to the innermost fitting region) terminates in a radially inwardly projecting slip-off preventive projection 20.

The tongue piece 22 has its slip-off preventive portion 20, which is the front end thereof, radially inwardly elastically urged, by its own elasticity, so that radially outward displacement of the slip-off preventive projection 20 produces a radially inward elastic reaction.

All of the inner surface of the tongue piece 22 but its top is inclined inwardly downward, and the lower surface (the innermost fitting portion surface) of the tongue piece 22, so that the longitudinal section of the slip-off preventive projection 20 is inwardly directed at an acute angle. The inner end of the slip-off preventive projection 20 projects somewhat inwardly into the inner diameter of the thick-walled cylindrical portion 12.

The bottom plate 16 positioned below the tongue piece 22 with a vertical (axial) spacing defined therebetween. The cylindrical inner peripheral surface of the thick-walled cylindrical portion 12, having the axial grooves 18 as discontinuous portions at two peripheral places, constitutes a holder-associated fitting portion 24.

The antislip body 50 comprises a substantially disk-like antislip portion 54 having 8 small equispaced projections 52 formed in the outer peripheral region of the upper surface, and a cylindrical antislip body-associated fitting portion 56 downwardly projecting from the central region of the antislip portion 54.

The outer diameter of the antislip body-associated fitting portion 56 is slightly smaller than the holder-associated fitting portion 24 and is chamfered around the outer periphery of the lower end thereof. The antislip body-associated fitting portion 56 has a radially outwardly opened circumferential annular slip-off preventive groove 58 (slip-off preventive recess) formed therein in a region somewhat above the lower end thereof. The lower surface of the annular slip-off preventive groove 58 is orthogonal to the axis and its upper surface is outwardly upwardly inclined.

The lower surface of the antislip portion 54, excluding its outer periphery, is shaped in the form of a shallow recess 54*a* gradually upwardly recessed toward the radially inward region. Further, the upper surface of the antislip portion 54 is gradually upwardly bulged toward the center and has a circular bulge 54*b* formed on the central region of the upper surface thereof, said bulge being slightly smaller in diameter than the antislip body-associated fitting portion 56.

Formed symmetrically on the antislip portion 54 at two places thereon spaced a central angle of 180 degrees apart are antislip body-associated insert receiving portions 60 of rectangular cross section vertically (axially) extending therethrough. The radially inward position of each antislip body-associated insert receiving portion 60 corresponds to a position around the outer periphery of the antislip body-associated fitting portion 56.

The cylindrical inner peripheral surface of the holder-associated fitting portion 24 in the holder 10 cooperates with the cylindrical outer peripheral surface of the antislip body-associated fitting portion 56 in the antislip body 50 to constitute a transverse support mechanism.

As shown in FIG. 3, when the antislip body-associated fitting portion 56 of the antislip body 50 is sufficiently fitted in the holder-associated fitting portion 24 of the holder 10 fixedly embedded in a golf shoe sole 80 (the shoe sole surface turned upward in FIG. 3), the slip-off preventive projections 20 at the front end of the tongue piece 22 are once elastically spread radially outward by the outer peripheral surface of the antislip body-associated fitting portion 56 during the fitting process, and then fits in the annular slip-off preventive groove 58. Since the slip-off preventive projections 20 are capable of fitting in the annular slip-off preventive groove 58 irrespective of the angle of rotation between the holder-associated fitting portion 24 and the antislip body-associated fitting portion 56, the operation of fitting the antislip body-associated fitting portion 56 in the holder-associated fitting portions 24 to thereby attach the antislip body 50 to the holder 10 is easy, not requiring the powerful force and trouble to fix it in position by firmly threadedly driving it against loosening. Further, the chamfered shape applied to the outer periphery of the lower end of the antislip body-associated fitting portion 56 cooperates with the inwardly downwardly inclined shape of the inner surfaces of the slip-off preventive projections 20 to allow said spreading and fitting process to proceed smoothly.

When the slip-off preventive projections 20 fits in annular slip-off preventive groove 58, this fitting is held by the radially inward urging force exerted by the tongue pieces 22 and by the facts that the lower surface of the annular slip-off preventive groove 58 is orthogonal to the axis and that the lower surfaces of the slip-off preventive projections 20 are outwardly upwardly inclined, thus preventing the antislip body-associated fitting portion 56 from being released upward from the holder-associated fitting portion 24; thus, the antislip body 50 is fixedly held on the holder 10. On this occasion, if the dimensions of the various parts are set such that the upper surface of the holder 10 is positioned in the shallow recess 54*a* and such that the outer periphery of the lower surface of the antislip portion 54 is positioned somewhat below the level of the upper surface of the holder 10 to press the surface of the synthetic rubber shoe sole 80, then the antislip body 50 is held more firmly by the elasticity of the antislip plate or the like and when the fit between the slip-off preventive projections 20 and the annular slip-off preventive groove 58 is canceled, the antislip body 50 is urged upward for easy removal.

When the user puts on the golf shoes each having a plurality of antislip bodies 50 held in a plurality of holders 10, the antislip function is exerted mainly by the small projections 52 formed on the antislip bodies 50. In that case, displacement and inclination of the antislip body-associated fitting portion 56 in a direction (transverse direction) orthogonal to the vertical direction (the direction of fit) with respect to the holder-associated fitting portion 24 is prevented by the transverse support mechanism; therefore, the drawbacks are prevented that the antislip bodies 50 are unstably held on the golf shoe sole 80 to fail to exert a sufficient antislip effect, that breakages or wear occurs in the holder-associated fitting portion 24 or antislip body-associated fitting portion 56, that the holding of the antislip body 50 by the holder 10 is canceled to allow the antislip body 50 to fall off during use, and so on.

When it is desired to release the antislip body 50 from the holder 10, inserts 92 bifurcately formed on a fit-canceling tool 90 are sufficiently inserted in the antislip body-associated insert receiving portions 60 and in the axial grooves 18. The shape and positional relation of the two inserts 92 are such that they can be simultaneously sufficiently inserted in the two antislip body-associated insert receiving portions 60. When simultaneously sufficiently inserted in the two antislip body-associated insert receiving portions 60 and in the axial grooves 18, the two inserts 92 press the inwardly downwardly inclined inner surfaces of the tongue pieces 22 to spread them radially outward, thereby canceling the fit of the slip-off preventive projections 20 in the annular slip-off preventive groove 58. Thereby, it is made possible to release the antislip body-associated fitting portions 56 upwardly from the holder-associated fitting portion 24 and detach the antislip body 50 from the holder 10.

FIGS. 4 through 11 show antislip devices for golf shoes (applicable to various other sport shoes and other articles of footwear) as other embodiments of footwear antislip devices of the present invention, and a fit-canceling tool of the present invention.

Figure 4:
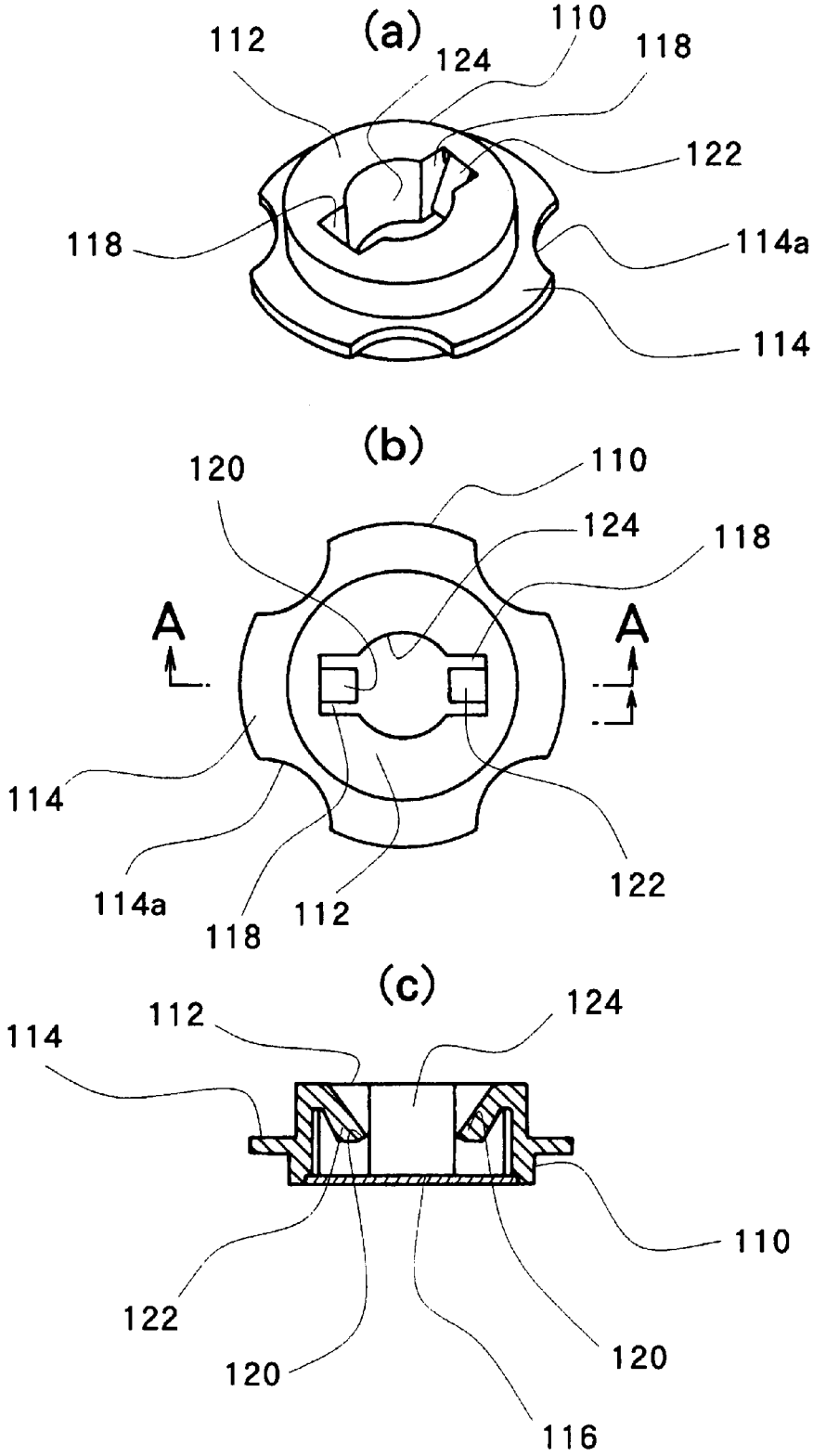
FIGS. 4*a–c* is a perspective view, a plan view and a sectional view of another holder.

FIG. 4 concerns a holder, wherein FIG. 4(*a*) is a perspective view, FIG. 4(*b*) is a plan view and FIG. 4(*c*) is a sectional view taken along the line A—A in FIG. 4(*b*).

Figure 5:
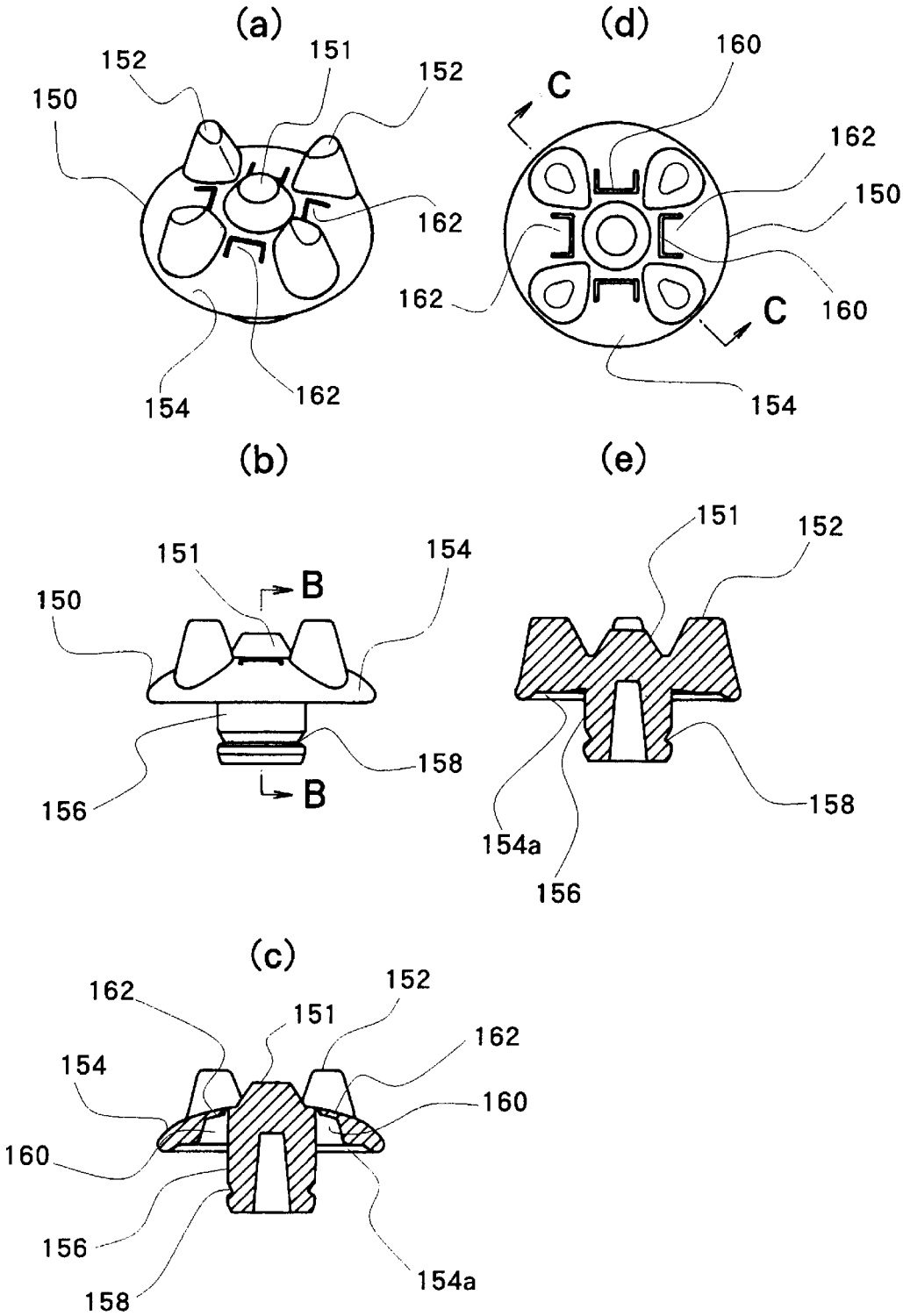
FIGS. 5*a–e* is a perspective view, a front view, a sectional view and a plan view of another antislip body.

FIG. 5 concerns an antislip body, wherein FIG. 5(*a*) is a perspective view, FIG. 5(*b*) is a front view, FIG. 5(*c*) is a sectional view taken along the line B—B in FIG. 5(*b*), FIG. 5(*d*) is a plan view, and FIG. 5(*e*) is a sectional view taken along the line C—C in FIG. 5(*d*).

Figure 6:
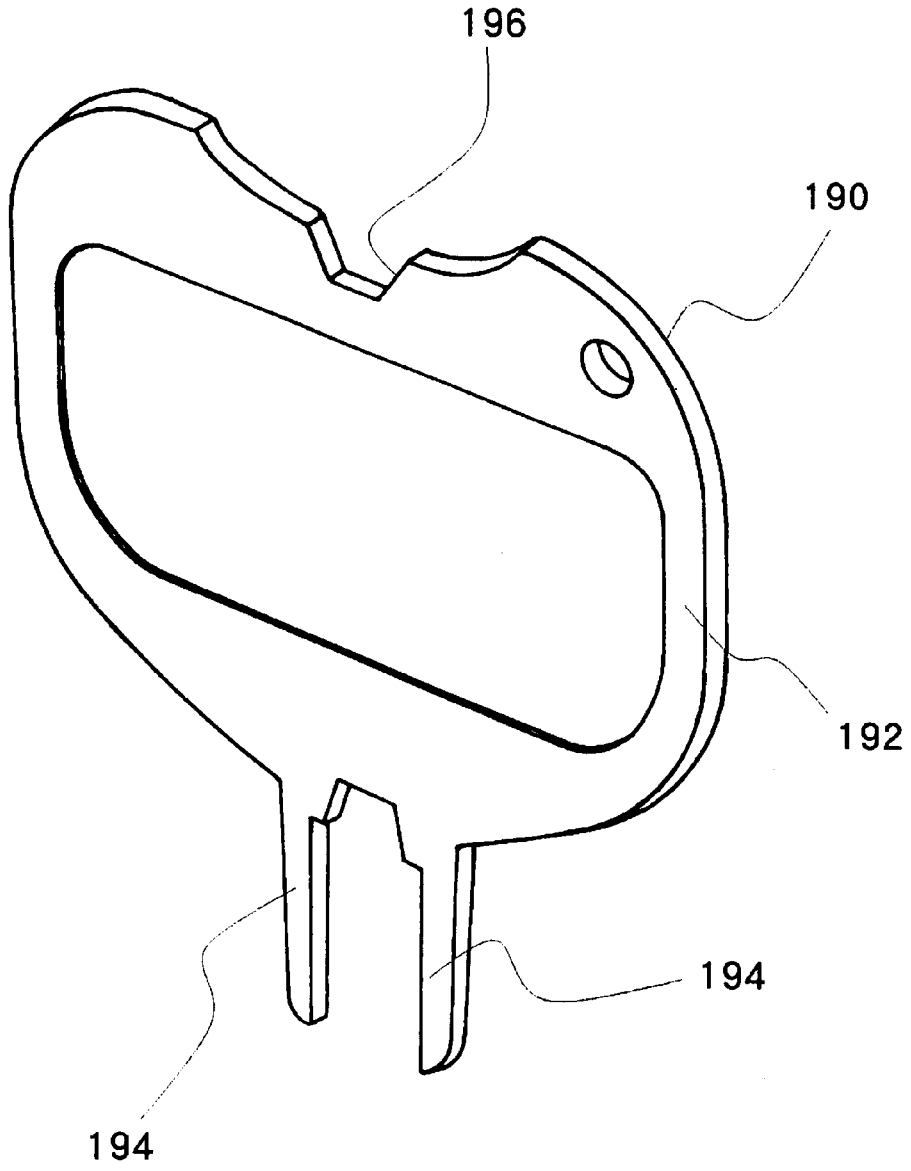
FIG. 6 is a perspective view of a fit-canceling tool.

FIG. 6 is a perspective view of a fit-canceling tool.

Figure 7:
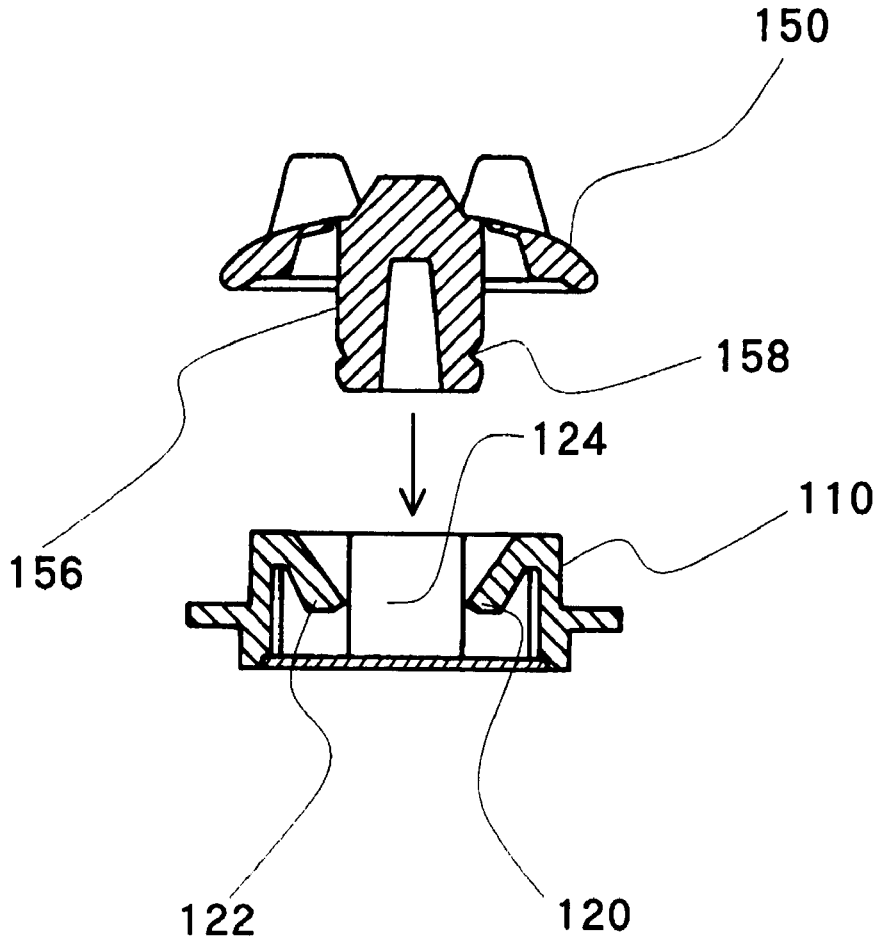
FIG. 7 is an explanatory sectional view showing how the antislip body is fitted and held in the holder.
Figure 8:
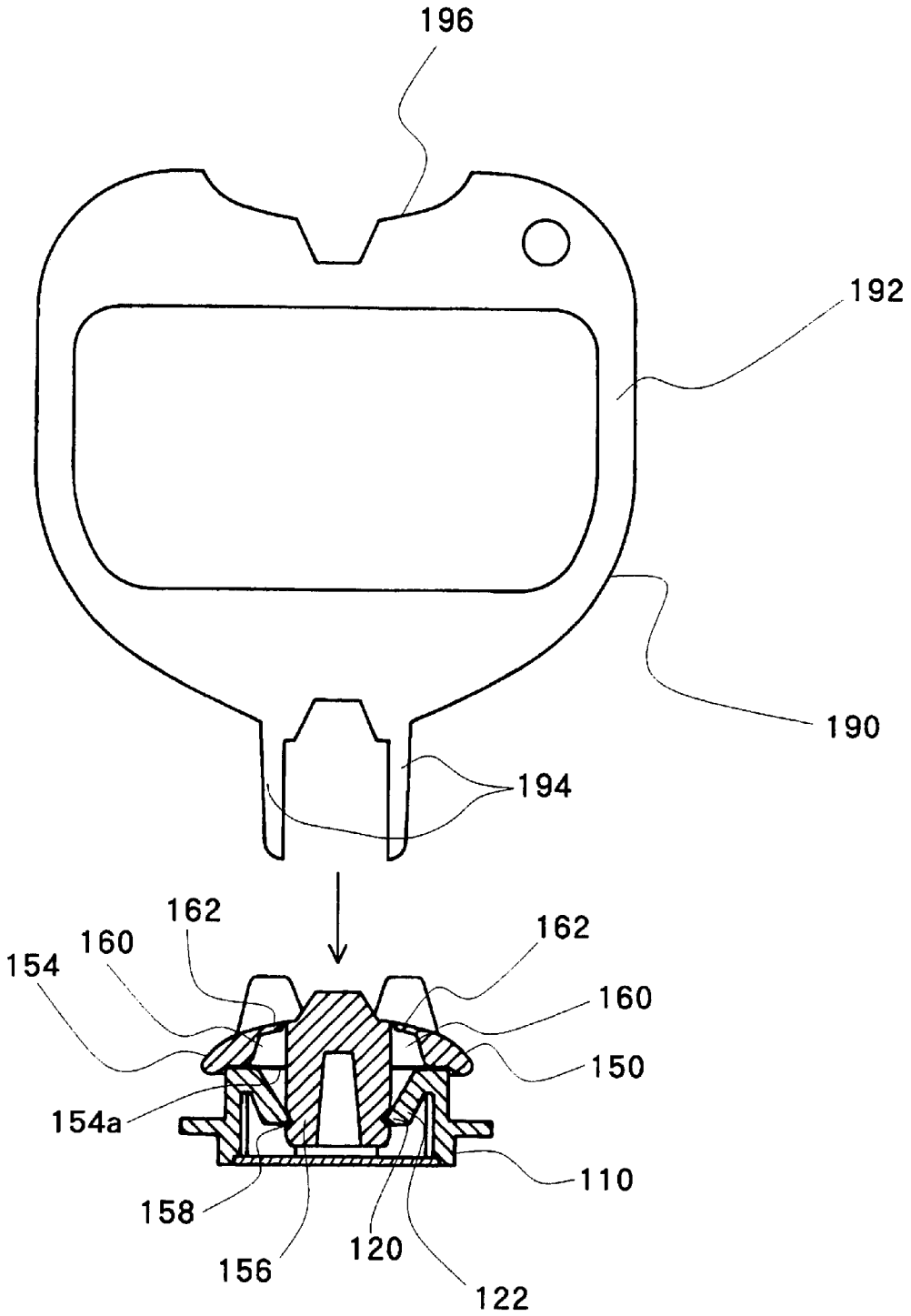
FIG. 8 is an explanatory sectional view showing how the inserts of the fit-canceling tool are inserted in the insert receiving portions of the antislip body fitted in the holder.
Figure 9:
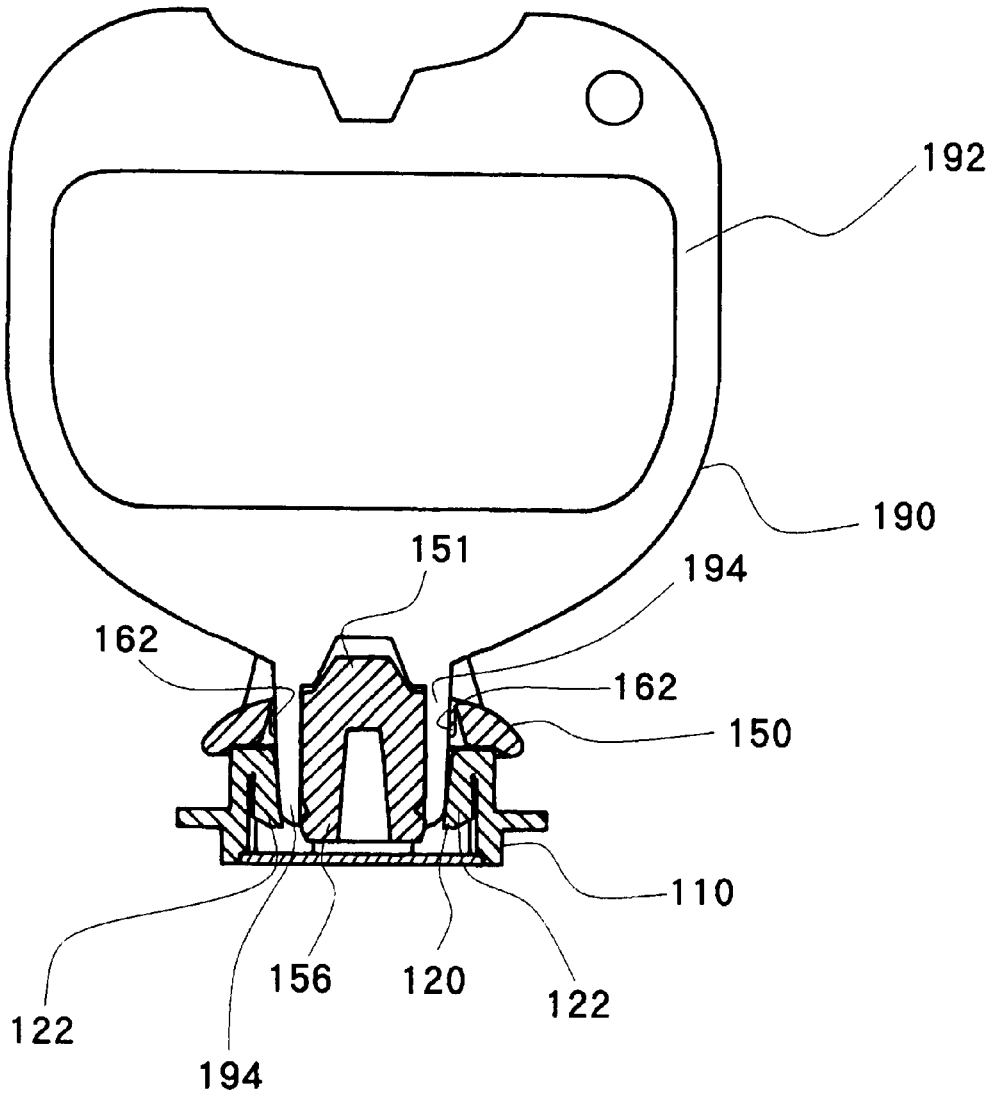
FIG. 9 is an explanatory sectional view showing a state in which the inserts of the fit-canceling tool have been inserted in the insert receiving portions of the antislip body fitted in the holder.
Figure 10:
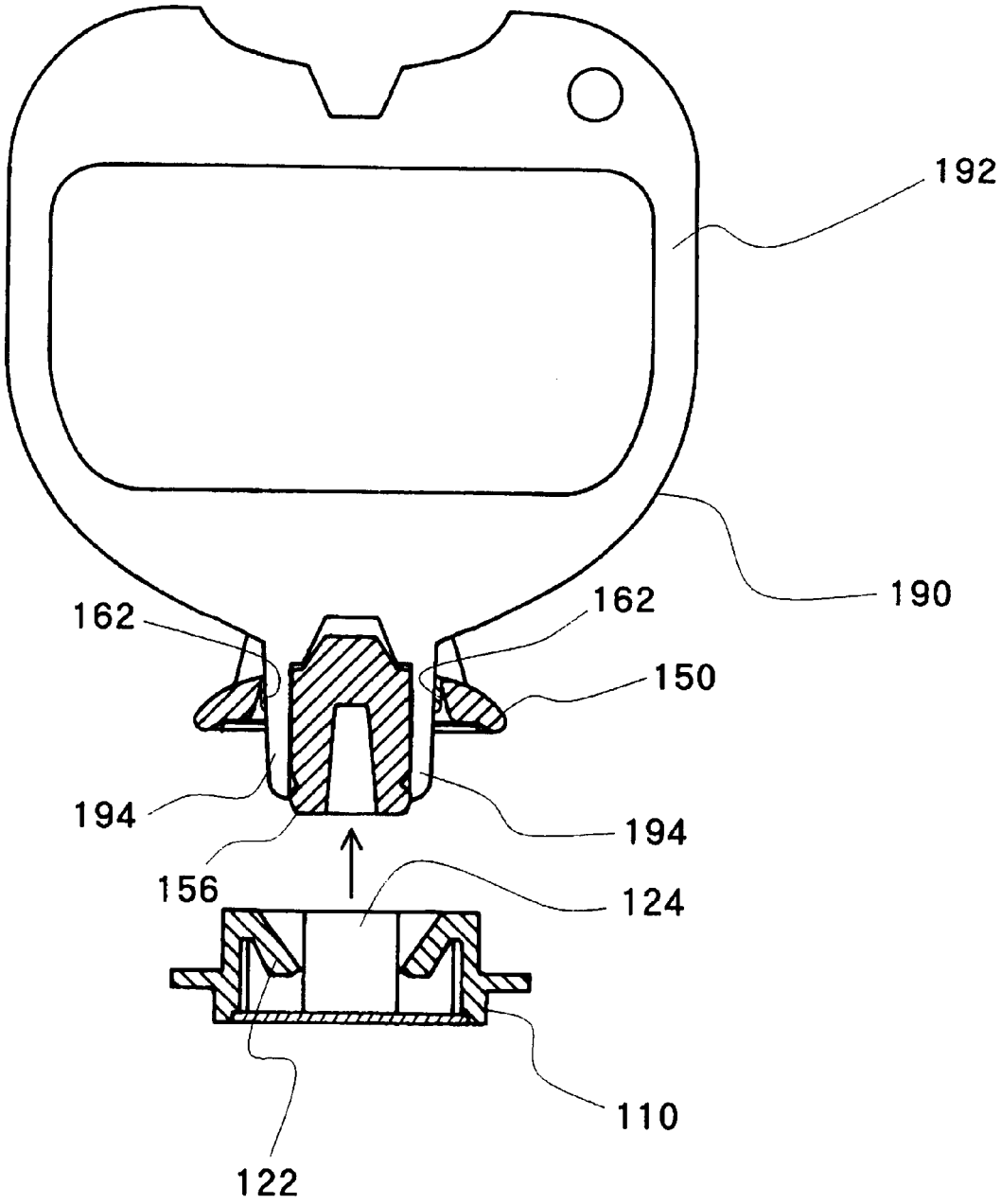
FIG. 10 is an explanatory sectional view showing a state in which the antislip body has been separated from the holder.

FIGS. 7 through 10 concern a method of using the antislip device and fit-canceling tool. FIG. 7 is an explanatory sectional view showing how the antislip body is fitted and held in the holder, FIG. 8 is an explanatory sectional view showing how the inserts of the fit-canceling tool are inserted in the insert receiving portions of the antislip body fitted in and held by the holder, FIG. 9 is an explanatory sectional view showing a state in which the inserts of the fit-canceling tool have been inserted in the insert receiving portions of the antislip body fitted in the holder, and FIG. 10 is an explanatory sectional view showing a state in which the antislip body has been separated from the holder.

Figure 11:
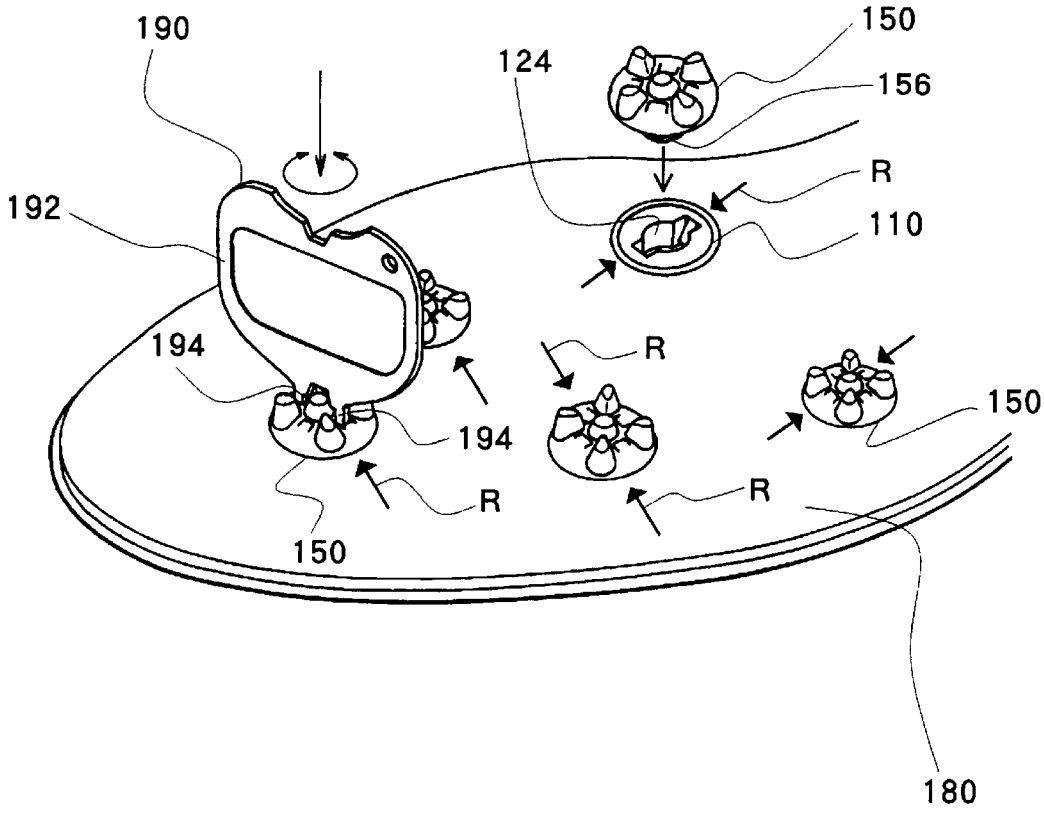
FIG. 11 is a perspective view showing how antislip bodies are to be mounted and dismounted by using antislip devices on a golf shoe sole.

FIG. 11 is a perspective view showing how antislip bodies are to be mounted and dismounted by using antislip devices on a golf shoe sole.

Figure 12:
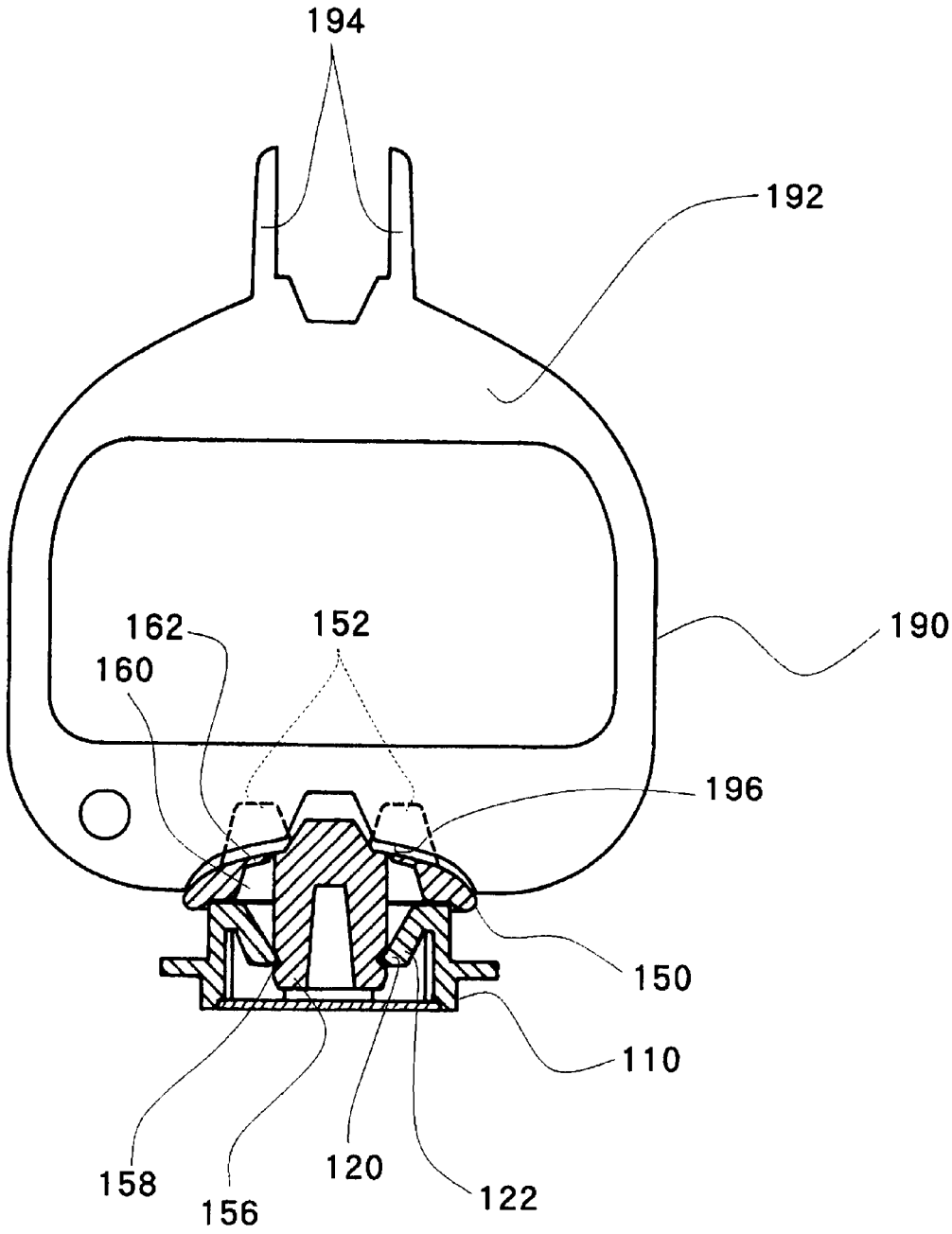
FIG. 12 is a sectional view showing how to turn the antislip body relative to the holder by using a turning recess.

FIG. 12 is a sectional view showing how to turn the antislip body relative to the holder by using a turning recess.

This antislip device consists of a holder 110 of 66 nylon resin and an antislip body 150 of polyurethane resin. Therefore, a golf shoe having this antislip device is lightweight, as compared with a conventional one.

The holder 110 comprises a thick-walled cylindrical portion 112, a flange 114, notches 114*a*, a bottom plate 116, axial grooves 118 (holder-associated insert receiving portions), slip-off preventive projections 120, and holder-associated fitting portion 124, in the same manner as in FIG. 1 except that the inner surface, including the upper portion, of a tongue piece 122 is inwardly downwardly inclined and that the inner end portion of the lower surface (the fitting innermost surface) is inwardly upwardly inclined at a deep angle with respect to the axis.

The holder 110 is used by being embedded in and fixed to a golf shoe sole 180 shown in FIG. 11 (in which the shoe sole surface is turned upward), and marked around each holder 110 in the golf shoe sole 180 are arrows R indicating the positions of the two axial grooves 118 and tongue pieces 122 in the holder 110.

An antislip body 150 comprises a substantially disk-like antislip portion 154 and a cylindrical antislip body-associated fitting portion 156 downwardly projecting from the central region of the antislip portion 154 in the holder 110.

The upper surface of the antislip portion 154 is gradually upwardly bulged toward the center. The upper surface of the antislip portion 154 has a small projection 151 circular as seen in a plan view, on its central region, and four substantially droplet-shaped projections 152 circumferentially equispaced therearound and radially inwardly tapered as seen in a plan view. The outer peripheral edge of the lower surface of the antislip portion 154 projects somewhat downwardly throughout the periphery, forming a shallow recess 154*a* on the inner peripheral side.

The outer diameter of the antislip body-associated fitting portion 156 is slightly smaller than the inner diameter of the holder-associated fitting portion 124, and the outer periphery of the lower end of the antislip body-associated fitting portion 156 is chamfered. The antislip body-associated fitting portion 156 has a radially outwardly opened circumferential annular slip-off preventive groove 158 (slip-off preventive recess) formed in its portion somewhat above its lower end. Annular slip-off preventive groove 158 is substantially V-shaped in section, and its upper surface is inclined relatively shallowly with respect to the axis while its lower surface is inclined deeply with respect to the axis.

Formed rotation-symmetrically on the antislip portion 154 at four places spaced a central angle of 90 degrees with the center at the axis apart from each other are insert receiving holes 160 (antislip body-associated insert receiving portions) of rectangular cross section vertically (axially) extending therethrough. The radially inward position of each insert receiving hole 160 corresponds to the outer peripheral position of the antislip body-associated fitting portion 156. The opening (which opens toward a surface to be trod by the golf shoe sole 180) positioned at the upper end of each insert receiving hole 160 has a valve flap 162 that can be depressed open by having an insert 194 inserted in the insert receiving hole 160 and that can be restored to its original position by having the insert 194 extracted therefrom, said valve flaps 162 substantially closing the openings in the insert receiving holes 160. Each valve flap 162 is of substantially rectangular shape, as seen in a plan view, somewhat smaller than the insert receiving hole 160 and is formed by integral molding together with the other portions of the antislip body 150 so that it may be opened and closed with its radially outward side used as a hinge.

The cylindrical inner peripheral surface of the holder-associated fitting portion 124 in the holder 110 cooperates with the cylindrical outer peripheral surface of the antislip body-associated fitting portion 156 in the antislip body 150 to constitute a transverse support mechanism, as in the example described above.

The fit-canceling tool 190 is formed of a synthetic resin plate, having a substantially heart-shaped grip 192 whose lower end middle portion terminates in a pair of downwardly projecting parallel inserts 194 and whose upper middle portion terminates in a turning recess 196 corresponding in shape to the upper surface of the antislip portion 154 and to the small projection 151 on the central region thereof. The space between the two inserts 194 is in the form of a recess adapted for the small projection 151 on the antislip portion 154 to fit in. In addition, each insert 194 assumes a bar form rectangular in cross section.

When the antislip body-associated fitting portion 156 of the antislip body 150 is sufficiently fitted in the holder-associated fitting portion 124, in a direction shown in FIGS. 11 and 7, of one of the holders 10 embedded in and fixed to the golf shoe sole 180 as shown in FIG. 11 (in which the shoe sole surface is turned upward), the slip-off preventive projections 120 at the front ends of the tongue pieces 122 are once elastically spread radially outward by the outer peripheral surface of the antislip body-associated fitting portion 156 during the fitting process, and then fits in the annular slip-off preventive groove 158, as shown in FIG. 8.

When the slip-off preventive projections 120 fit in the annular slip-off preventive groove 158, this fitting is held by the radially inward urging force exerted by the tongue pieces 122 and by the fact that the lower surface of the annular slip-off preventive groove 158 and the inner ends of the lower surfaces of the tongue pieces 122 are deeply inclined with respect to the axis, thus preventing the antislip body-associated fitting portion 156 from being released upward from the holder-associated fitting portion 124; thus, the antislip body 150 is fixedly held on the holder 110. On this occasion, the upper surface of the holder 110 is positioned in the shallow recess 154*a* formed in the lower surface of the antislip portion 154 while the outer peripheral edge of the lower surface of the antislip portion 154 is positioned somewhat below the level of the upper surface of the holder 110, in which state the outer peripheries of the antislip body 150 and holder 110 press against each other throughout the periphery, thereby preventing particles of stone, sand or earth, grass, dust, dirt, etc. from entering between the antislip body 150 and the holder 110 from the outer periphery thereof to clog the inner space; thus, the cancellation of the fit between the slip-off preventive projection 120 and the slip-off preventive groove 158 and between the antislip body-associated fitting portion 156 and the holder-associated fitting portion can be reliably effected.

When the user puts on the golf shoes each having a plurality of antislip bodies 150 held in a plurality of holders 110, the antislip function is exerted mainly by the small projections 152 formed on the antislip bodies 150.

The antislip bodies 150 are turnable around their axes relative to the holders 110, i.e., the golf shoe sole 180, a fact which is effective to protect turf or the like or to prevent wear of the antislip bodies 150. In addition, if the degree of wear of the projections 152 differs according to their positions, this problem can be dealt with, as shown in FIG. 12, by the user timely fitting the turning recess 196 of the fit-canceling tool on the upper surface of the antislip portion 154 and on the central small projection 151 and, in this state, turning the fit-canceling tool by the grip 192, whereby the peripheral edge of the turning recess 196 acts on the projections 152 on the antislip portion 154 to turn the antislip body 150 to thereby uniformalize the wear and hence prolong the life.

When it is desired to release the antislip body 150 from the holder 110, this can be attained by inserting a pair of inserts 194 parallelly formed on the fit-canceling tool 190 in any pair of opposed insert receiving holes 160 and, in this state, turning the grip 192 and hence the antislip body 150, as occasion arises, as shown in FIG. 11, to align the rotation angle positions of the inserts 194 and the insert receiving holes 160 having the inserts 194 inserted therein with the positions of the two axial grooves 118 indicated by arrows R on the golf shoe sole 180, whereupon said pair of inserts 194 are sufficiently inserted in the axial grooves 118. Since there are two pairs of insert receiving holes 160 in which a pair of inserts 194 can be inserted, the probability that such insert receiving holes 160 get clogged to become unable to receive the inserts 194 is reduced, so that cancellation of fit can be effected more reliably. Further, a smaller angle of rotation is sufficient to align the rotation angle positions of the inserts 194 and the insert receiving holes 160 having the inserts 194 inserted therein with the two axial grooves 118.

When the inserts 194 are inserted in the insert receiving holes 160, the valve flaps 162 substantially closing the openings in the insert receiving holes 160 are depressed open. Since the insert receiving holes 160 are normally substantially closed by the valve flaps 162, the insert receiving holes 160 are prevented from clogging to become incapable of receiving the inserts 194 therein, so that the cancellation of fitting can be effected more reliably.

When the two inserts 194 are simultaneously fully inserted in the two axial grooves 118 through the two insert receiving holes 160, the two inserts 194 press the inwardly downwardly inclined inner surfaces of the tongue pieces 122 to spread the latter radially outward, thereby canceling the fit of the slip-off preventive projections 120 in the annular slip-off preventive groove 158. This allows the antislip body-associated fitting portion 156 to be upwardly released from the holder-associated fitting portion 124 so as to remove the antislip body 150 from the holder 110. In that case, the elastic repulsive force from the outwardly spread tongue pieces 122 pushes the two inserts 194 upward, while the valve flaps 162 elastically press the two inserts 194 in the vicinity of the openings in the insert receiving holes 160, whereby the valve flaps 162 of the antislip body 150 press and hold the inserts 194. Therefore, the antislip body 150 can be easily released by moving the grip 192 in the direction of release of the antislip body 150, as shown in FIG. 10.

In addition, when the inserts 194 are extracted from the insert receiving holes 160, the valve flaps 162 are elastically restored to their original positions.

Figure 13:
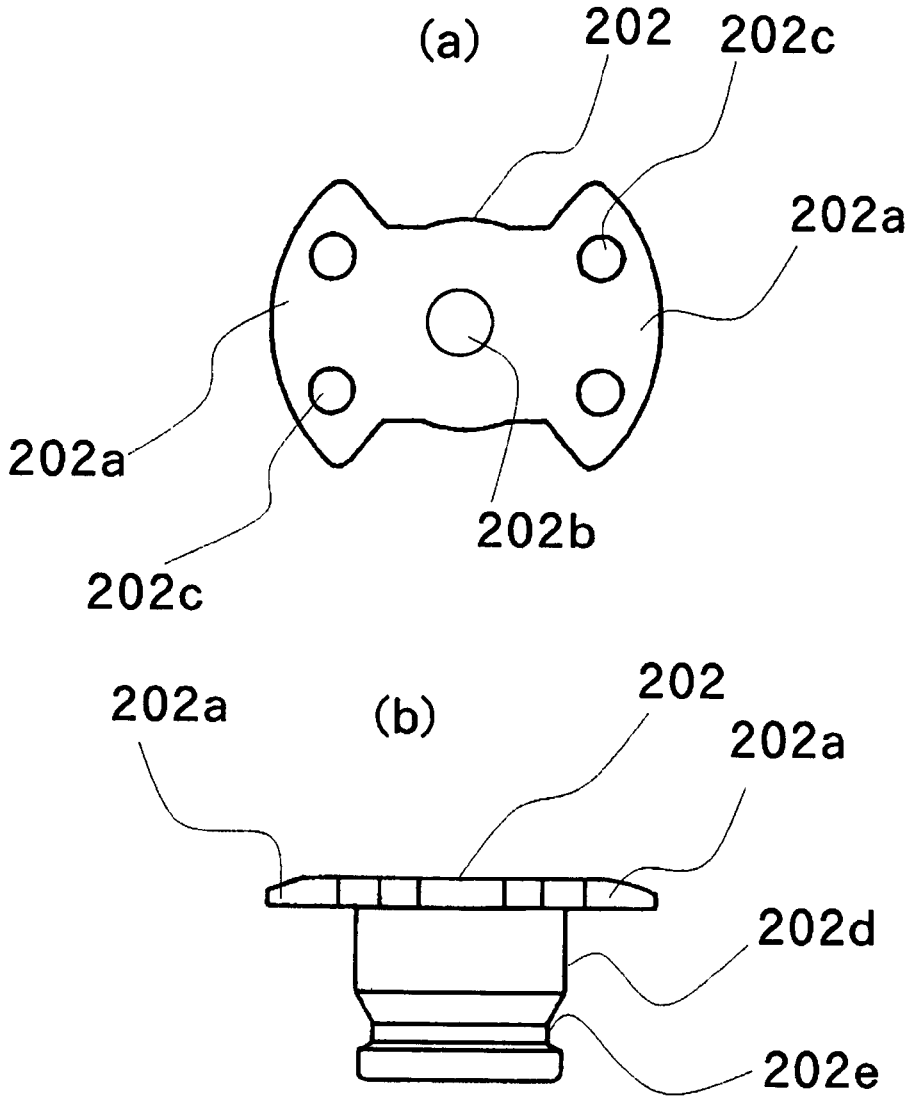
FIG. 13 is a plan view and a front view of a pillar-like body.
Figure 14:
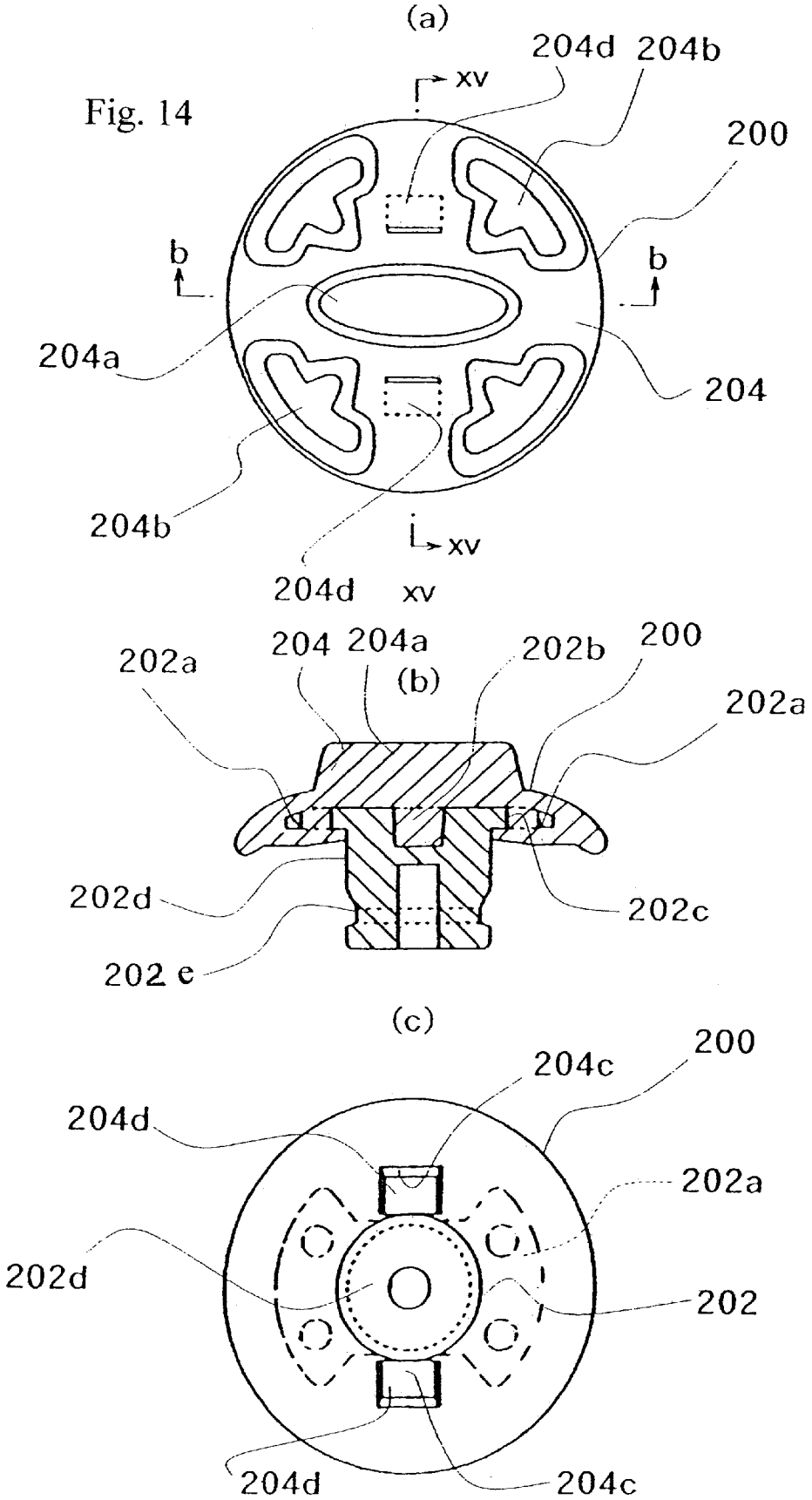
FIGS. 14*a–c* is a plan view, a sectional view taken along the line b—b, and a bottom view of the antislip body.
Figure 15:
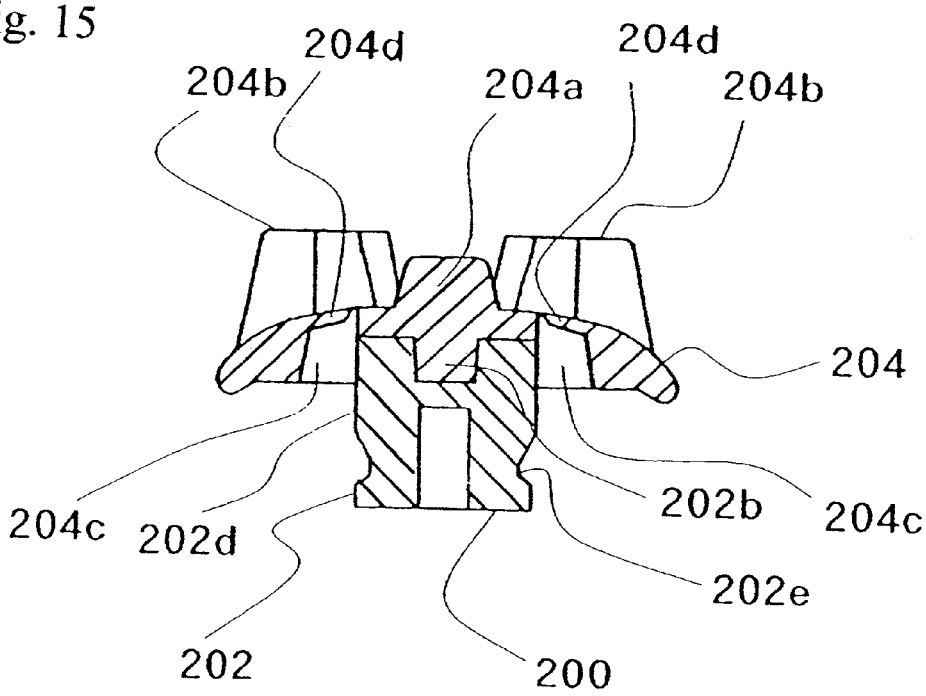
FIG. 15 is a sectional view taken along the line XV—XV in FIG. 14(*a*).

FIGS. 13 through 15 concern an antislip body for a antislip device for golf shoes (applicable to various other sport shoes and other articles of footwear), shown as another embodiment of a footwear antislip device according to the present invention.

FIG. 13 concerns a pillar-like body, wherein FIG. 13(*a*) is a plan view and FIG. 13(*b*) is a front view.

FIGS. 14 and 15 concern an antislip body, wherein FIG. 14(*a*) is a plan view, FIG. 14(*b*) is a sectional view taken along the line b—b in FIG. 14(*a*) (projections being omitted), FIG. 14(*c*) is a bottom view, and FIG. 15 is a sectional view taken along the line XV—XV in FIG. 14(*a*).

This antislip body 200 comprises a cylindrical body 202 of 66 nylon resin (a rigid synthetic resin) and an antislip portion 204 of polyurethane resin (a relatively soft synthetic resin).

The upper end of the cylindrical body 202 has a pair of horizontally extending, opposed, lateral extensions 202*a* substantially sector-shaped as seen in a plan view, as shown in FIG. 14.

By forming the antislip portion 204 in such a manner as to mold and solidify the lateral extensions 202*a* in such a manner as to cover the latter with polyurethane resin (a relatively soft synthetic resin), the antislip body 200 is constituted such that the cylindrical body 202 and the antislip portion 204 are integrated with the antislip portion 204 covering the lateral extensions 202*a* from above and below and from the outer periphery. As the polyurethane resin also reaches a recess 202*b* open to the upper central region of the cylindrical body 202 and through-holes 202*c* formed in the lateral extensions 202*a*, the integration of the cylindrical body 202 and antislip portion 204 is strengthened.

Of the cylindrical body 202, the portion extending downward from the antislip portion 204 is an antislip body-associated fitting portion 202*d*. Formed in the antislip body-associated fitting portion 202*d* somewhat above the lower end thereof is a radially outwardly opened, circumferential annular slip-off preventive groove 202*e* (slip-off preventive recess). The annular slip-off preventive groove 202*e* has a flat bottom and is substantially V-shape in section, and its upper surface is inclined relatively shallowly with respect to the axis while its lower surface is inclined deeply with respect to the axis.

The upper surface of the antislip portion 204 is gradually upwardly bulged toward the center. The upper surface of the antislip portion 204 has an upwardly directed central projection 204*a* horizontally centrally extending in FIG. 14 and substantially elliptic as seen in a plan view, and four upwardly directed projections 204*b* circumferentially equispaced therearound and each in the form of an arc having a central angle of about 50 degrees as seen in a plan view with its middle portion projecting toward the center. The outer peripheral edge of the lower surface of the antislip portion 204 projects somewhat downwardly throughout the periphery, forming a shallow recess on the inner peripheral side.

The antislip portion 204 has insert receiving holes 204*c* rectangular in section (antislip body-associated insert receiving portions) vertically (axially) extending therethrough and formed at two transversely symmetrical places in FIG. 14. Disposed on the openings positioned at the upper ends of these insert receiving holes 204*c* (which openings open to a surface to be trod by the golf shoe sole) are valve flaps 204*d* that can be depressed open by having the inserts 194 inserted in the insert receiving holes 204*c* and that can be restored to its original position by having said inserts 194 extracted therefrom, said valve flaps 204*d* substantially closing the openings in the insert receiving holes 204*c*. Each valve flap 204*d* is of substantially rectangular shape, as seen in a plan view, somewhat smaller than the insert receiving hole 204*c* and is formed by integral molding together with the other portions of the antislip portion 204 so that it may be opened and closed with its radially outward side used as a hinge.

When the valve flaps 204*d* are in their closed state, the positions of the insert receiving holes 204*c* may sometimes be somewhat difficult to look at. However, since the radial positions of the insert receiving holes 204*c* are located inside between the opposite ends of the longer length of the central projection 204*a* or are equivalent spaced, the operation of inserting the inserts 194 in the two insert receiving holes 204*c* positioned on the opposite sides of the shorter length of the central projection 204*a* is easy.

If this antislip body 200 is combined with the holder 110 made of a rigid synthetic resin, such as 66 nylon resin, to use it as an antislip device, it contributes much to preventing damage to greens, building floors, etc. and improving the wearing feel, because the antislip portion 204 of the antislip body 200 is relatively soft. And since the annular slip-off preventive groove 202*e* and the slip-off preventive projections 120 are made of a rigid synthetic resin, undesirable occurrences are prevented in which an unexpected force acts during use to cancel the fit between the annular slip-off preventive groove 202*e* and the slip-off preventive projections 120 or in which the annular slip-off preventive groove 202*e* or the slip-off preventive projections 120 wear out so that the fit therebetween is accidentally canceled.

In addition, the vertical positional relation in the description of the above embodiments is for convenience of description based on the drawings and is not intended to restrict the manner of actual use, etc.

What is claimed is:

1. An antislip device for footwear, comprising a holder used by being fixed to the bottom of footwear, and an antislip body to be held in said holder, said antislip body having an antislip portion that, when the antislip body is held in the holder fixed to the bottom of the footwear, contacts a surface to be trod by the bottom of the footwear so as to prevent the footwear from slipping relative to said surface, said holder and said antislip body have a holder-associated fitting portion and an antislip body-associated fitting portion, respectively, that fit together, said holder-associated fitting portion and said antislip body-associated fitting portion have a transverse support mechanism capable of preventing a relative movement between them in a direction orthogonal to the direction of fit when said antislip body-associated fitting portion fits in said holder-associated fitting portion, of such things as a slip-off preventive recess and a slip-off preventive projection capable of fitting in said slip-off preventive recess when the holder-associated fitting portion and the antislip body-associated fitting portion are fitted together, one is possessed by the holder and the other by the antislip body, either said holder or antislip body has a cantilever-like portion having elasticity, said cantilever-like portion has said slip-off preventive projection, either said slip-off preventive recess constituting portion or said slip-off preventive projection possessed by the cantilever-like portion is urged by the elasticity of the cantilever-like portion in a direction in which it can be fitted to the other, said slip-off preventive recess and said slip-off preventive projection being shaped such that when they are relatively moved in a direction in which they are fitted together, they can be fitted together and when they are relatively moved in the opposite direction, their fitting is not canceled, radially outside the slip-off preventive recess, one or more insert receiving portions being provided in which fit-canceling inserts can be inserted when the antislip body is in the state of being held in the holder fixed to the bottom of the footwear, said urged slip-off preventive recess constituting portion or slip-off preventive projection canceling the fit between the two by a canceling force opposite in direction to said urging force that the cantilever-like portion receives outside the slip-off preventive recess from the inserts directly when the fit-canceling inserts are sufficiently inserted in the insert receiving portions.

2. An antislip device for footwear of claim 1, including a direction-of-fit support mechanism that supports such that when the antislip body-associated fitting portion is fitted to the holder-associated fitting portion, the depth of fitting is prevented from exceeding a certain limit.

3. An antislip device for footwear of claim 1, wherein the antislip body-associated fitting portion is a fitting projection having a cylindrical outer peripheral surface that may have one or more circumferentially disposed discontinuous portions, while the holder-associated fitting portion is a fitting recess having a cylindrical inner peripheral surface that may have one or more circumferentially disposed discontinuous portions, said cylindrical outer and inner peripheral surfaces constituting the transverse support mechanism.

4. An antislip device for footwear of claim 3, wherein when the holder-associated fitting portion and antislip body-associated fitting portion are fitted together, they are relatively turnable around the axis extending in the direction of fit, and the antislip body-associated fitting portion has a circumferentially endlessly continuous groove-like slip-off preventive recess while the holder has one or more slip-off preventive projections capable of fitting in said slip-off preventive recess.

5. An antislip device for footwear of claim 4, wherein the holder has one or more cantilever-like portions each having a base portion on the fitting port side of the holder-associated fitting portion and a radially inwardly projecting slip-off preventive projection at the front end extending toward the innermost fitting region, said cantilever-like portion having an inner surface that is radially inwardly inclined toward the innermost fitting portion when the slip-off preventive it projection is fitted in the slip-off preventive recess, the arrangement being such that when the fit-canceling inserts are sufficiently inserted in the insert receiving portions, the inserts press and radially outwardly elastically deform the inner surfaces thereof, thereby canceling the fit between the slip-off preventive projection and the slip-off preventive recess.

6. An antislip device for footwear of claim 3, wherein when the holder-associated fitting portion and the antislip body-associated fitting portion are fitted together, they are relatively turnable around the axis extending in the direction of fit, the holder has a slip-off preventive projection while the antislip body-associated fitting portion has a slip-off preventive recess, said slip-off preventive projection being urged in a direction in which it can fit in said slip-off preventive recess, the insert receiving portion comprises an antislip body-associated insert receiving portion extending through the antislip body and a holder-associated insert receiving portion possessed by the holder, the arrangement being such that with the rotation angle position of the antislip body-associated insert receiving portion coinciding with the position of the holder-associated insert receiving portion, the fit-canceling insert inserted in said antislip body-associated insert receiving portion is sufficiently inserted in the holder-associated insert receiving portion, thereby making it possible to cancel the fit between the slip-off preventive projection and the slip-off preventive recess.

7. An antislip device for footwear of claim 6, wherein the number of antislip body-associated insert receiving portions is greater than the number of holder-associated insert receiving portions, and the antislip body has two or more angles of rotation relative to the holder such that the position of the antislip body-associated insert receiving portion coincides with the position of the holder-associated insert receiving portion, the cancellation of the fit between the slip-off preventive projection and the slip-off preventive recess is made possible, which, in turn, makes possible the cancellation of the fit between the antislip body-associated fitting portion and the holder-associated fitting portion.

8. An antislip device for footwear of claim 1, wherein the antislip portion has a substantially plate-shape portion so that when the antislip body is held in the holder, the outer periphery of the antislip body and the outer periphery of the holder press against each other throughout the periphery.

9. An antislip device for footwear of claim 1, wherein the insert receiving portion has an opening that opens to a surface to be trod by the bottom of the footwear when the antislip device is attached to the bottom of the footwear to be ready for use, through which opening the fit-canceling insert can be inserted in the insert receiving portion, said opening having a valve flap that is pushed open toward the insert receiving portion by inserting said insert in said insert receiving portion and that is restored to its original position by extracting said insert from said insert receiving portion, said opening being closed or substantially closed by said valve flap.

10. An antislip device for footwear of claim 9, wherein the insert receiving portion comprises an antislip body-associated insert receiving portion extending through the antislip body and a holder-associated insert receiving portion possessed by the holder, the opening in the antislip body-associated insert receiving portion has a valve flap, the arrangement being such that when the insert is inserted in the insert receiving portion, said valve body elastically presses the insert in the vicinity of the opening.

11. An antislip device for footwear of claim 1, wherein the antislip portion of the antislip body is made of relatively soft material, while the slip-off preventive recess and the slip-off preventive projection are made of relatively rigid material.

12. An antislip device for footwear of claim 4, wherein the antislip portion of the antislip body is made of relatively soft material, while the antislip body-associated fitting portion and the holder are made of relatively rigid material.

13. An antislip device for footwear of claim 11, wherein the antislip body is an integral combination of a pillar-like body of relatively rigid material whose one end has lateral extensions and whose other end constitutes an antislip body-associated fitting portion, and an antislip portion of relatively soft material covering said lateral extensions of said pillar-like body.

14. A holder for an antislip device for footwear, said antislip device comprising said holder used by being fixed to the bottom of the footwear, and an antislip body to be held in said holder, said antislip body having an antislip portion that, when the antislip body is held in the holder fixed to the bottom of the footwear, contacts a surface to be trod by the bottom of the footwear so as to prevent the footwear from slipping relative to said surface, said holder and said antislip body have a holder-associated fitting portion and an antislip body-associated fitting portion, respectively, that fit together, said holder-associated fitting portion and said antislip body-associated fitting portion have a transverse support mechanism capable of preventing a relative movement between them in a direction orthogonal to the direction of fit when said antislip body-associated fitting portion fits in said holder-associated fitting portion, of such things as a slip-off preventive recess and a slip-off preventive projection capable of fitting in said slip-off preventive recess when the holder-associated fitting portion and the antislip body-associated fitting portion are fitted together, one is possessed by the holder and the other by the antislip body, either said holder or antislip body has a cantilever-like portion having elasticity, said cantilever-like portion has said slip-of preventive recess or said slip-off preventive projection, either said slip-off preventive recess constituting portion or said slip-off preventive projection possessed by the cantilever-like portion is urged by the elasticity of the cantilever-like portion in a direction in which it can be fitted to the other, said slip-off preventive recess and said slip-off preventive projection being shaped such that when they are relatively moved in a direction in which they are fitted together, they can be fitted together and when they are relatively moved in the opposite direction, their fitting is not canceled, radially outside the slip-off preventive recess, one or more insert receiving portion being provided in which fit-canceling inserts can be inserted when the antislip body is in the state of being held in the holder fixed to the bottom of the footwear, said urged slip-off preventive recess constituting portion or slip-off preventive projection canceling the fit between the two by a canceling force opposite in direction to said urging force that the cantilever-like portion receives outside the slip-off preventive recess from the inserts directly when the fit-canceling inserts are sufficiently inserted in the insert receiving portions.

15. An antislip body for an antislip device for footwear, said antislip device comprising a holder used by being fixed to the bottom of the footwear, and said antislip body to be held in said holder, said antislip body having an antislip portion that, when the antislip body is held is the holder fixed to the bottom of the footwear, contacts a surface to by trod by the bottom of the footwear so as to prevent the footwear from slipping relative to said surface, said holder and said antislip body have a holder-associated fitting portion and an antislip body-associated fitting portion, respectively, that fit together, said holder-associated fitting portion and said antislip body-associated fitting portion have a transverse support mechanism capable of preventing a relative movement between them in a direction orthogonal to the direction of fit when said antislip body-associated fitting portion fits in said holder-associated fitting portion, of such things as a slip-off preventive recess and a slip-off preventive projection capable of fitting in said slip-off preventive recess when the holder-associated fitting portion and the antislip body-associated fitting portion are fitted together, one is possessed by the holder and the other by the antislip body, either said holder or antislip body has a cantilever-like portion having elasticity, said cantilever-like portion has said slip-off preventive recess or said slip-off preventive projection, either said slip-off preventive recess constituting portion or said slip-off preventive projection possessed by the cantilever-like portion is urged by the elasticity of the cantilever-like portion in a direction in which it can be fitted to the other, said slip-off preventive recess and said slip-off preventive projection being shaped such that when they are relatively moved in a direction in which they are fitted together, they can be fitted together and when they are relatively moved in the opposite direction, their fitting is not canceled, radially outside the slip-off preventive recess, one or more insert receiving portions being provided in which fit-canceling inserts can be inserted when the antislip body is in the state of being held in the holder fixed to the bottom of the footwear, said urged slip-off preventive recess constituting portion or slip-off preventive projection canceling the fit between the two by a canceling force opposite in direction to said urging force that the cantilever-like portion receives outside the slip-off preventive recess from the inserts directly when the fit-canceling inserts are fully inserted in the insert receiving portions.

16. A device in accordance with claim 1, wherein:

said urging force from the inserts in said insert receiving portions is received by said slip-off preventive recess or said slip-off preventive projection outside said slip-off preventive recess.

17. A device in accordance with claim 1, wherein:

when the holder-associated fitting portion and antislip body-associated fitting portion are fitted together, they are relatively turnable around the axis extending in the direction of fit, and one of the antislip body-associated fitting portion and the holder has a circumferentially endlessly continuous groove-like slip-off preventive recess while the other has one or more slip-off preventive projections capable of fitting in said slip-off preventive recess.

18. A device in accordance with claim 16, wherein:

when the holder-associated fitting portion and antislip body-associated fitting portion are fitted together, they are relatively turnable around the axis extending in the direction of fit, and one of the antislip body-associated fitting portion and the holder has a circumferentially endlessly continuous groove-like slip-off preventive recess while the other has one or more slip-off preventive projections capable of fitting in said slip-off preventive recess.

19. An anti-slip device for footwear, the device comprising:

a holder fixable to a bottom of the footwear, said holder including a cylindrical wall defining a body opening;

a projection extending from said cylindrical wall;

an anti-slip body including a fitting portion insertable into said body opening in a fit direction, said fitting portion and said body opening having a shape for blocking relative movement between said anti-slip body and said holder in a direction orthogonal to said fit direction, said fitting portion having a cylindrical surface, said fitting portion defining a recess arranged radially inside said cylindrical surface, said recess being receivable of said projection, said recess and said projection having a shape to block movement of said anti-slip body in a direction opposite to said fit direction when said projection is arranged in said recess;

said holder and said anti-slip body define an insert receiving portion arranged radially outside said cylindrical surface of said fitting portion, said projection being arranged in said insert receiving portion, said insert receiving portion being receivable of an insert which moves said projection out of said recess.

20. A device in accordance with claim 19, wherein:

said anti-slip body includes a disk portion contactable with the bottom of the footwear when the anti-slip body is arranged in said holder, said insert receiving portion passing through said disk portion.

21. A device in accordance with claim 19, wherein:

said anti-slip body is rotatably arranged in said holder about said fit direction;

said recess extends circumferentially around said fitting portion.

* * * * *